United States Patent [19]

Off et al.

[11] 4,261,787

[45] Apr. 14, 1981

[54] APPARATUS AND METHOD FOR PREFABRICATING POCKETS

[76] Inventors: Joseph W. A. Off, 1201 Limetree La., Irving, Tex. 75061; Judson H. Early, 3207 Kiesthill, Dallas, Tex. 75233; William B. Greer, 1923 W. Freeway #3, Grand Prairie, Tex. 75051

[21] Appl. No.: 81,039

[22] Filed: Oct. 1, 1979

Related U.S. Application Data

[62] Division of Ser. No. 971,022, Dec. 19, 1978, Pat. No. 4,226,661.

[51] Int. Cl.[3] ..... B44C 1/10; B32B 31/00

[52] U.S. Cl. ..... 156/540; 156/584

[58] Field of Search ..... 156/540, 584, 510, 523

[56] References Cited

U.S. PATENT DOCUMENTS

| | | | |
|---|---|---|---|
| 2,600,322 | 6/1952 | Raney | 156/521 |
| 3,654,015 | 4/1972 | Purcell | 156/217 |
| 3,765,992 | 10/1973 | Stageberg | 156/521 |
| 3,828,367 | 8/1974 | Bourgeois | 156/217 |
| 3,892,620 | 7/1975 | Heussy | 156/510 |
| 3,955,481 | 11/1976 | Heitmann | 156/521 |
| 3,992,244 | 11/1976 | Craig | 156/521 |
| 4,026,754 | 5/1977 | Bogdanski | 156/521 |
| 4,096,020 | 6/1978 | Basu | 156/519 |

*Primary Examiner*—Douglas J. Drummond

*Attorney, Agent, or Firm*—Richards, Harris & Medlock

[57] ABSTRACT

In an apparatus and method for prefabricating pockets continuously, pocket material is directed lengthwise along a predetermined path. The pocket material is nipped between a feed roller and an idler roller for advancement first to an adhesive application station. In one embodiment, predetermined adhesive strips formed from ribbons comprising a layer of fusible adhesive on a backing are attached along the edges of the pocket material. If desired, a transverse strip of adhesive can also be applied. In the alternative, adhesive can be extruded directly onto the pocket material along the edges and transversely if desired. The pocket material is then advanced past a cutter and sheared to provide an individual pocket blank. The pocket blank is next aligned, after which the aligned pocket blank is transferred into position for transverse folding. In the preferred embodiment, the edges of the pocket blank having adhesive there along are folded inwardly simultaneously upon transfer. A movable blade then folds the pocket blank transversely and advances the folded pocket blank into one of a plurality of pocket receivers in a rotatable pocket wheel. As the wheel is indexed, the edges of the folded pocket blank are engaged and activated to permanently secure the edges and thereby form a pocket. The prefabricated pockets are then removed for subsequent implantation into a garment.

13 Claims, 32 Drawing Figures

| ABBR. | DEFINITION |
|---|---|
| APP | ADHESIVE APPLICATOR |
| B.C. | BOTTOM CATCHER |
| CLR | CLEAR |
| CNT | COUNT |
| CRRG | CARRIAGE |
| DIS | DISABLE |
| GPI | GENERAL PURPOSE INTERFACE |
| OM | OPERATORS MANUAL STATUS |
| P.B. | PUSH BUTTON |
| PDC | PROGRAMMABLE COUNTER |
| PW | POCKET WHEEL |
| S/R | SUBROUTINE |
| STKR | STACKER |

START UP & AUTO

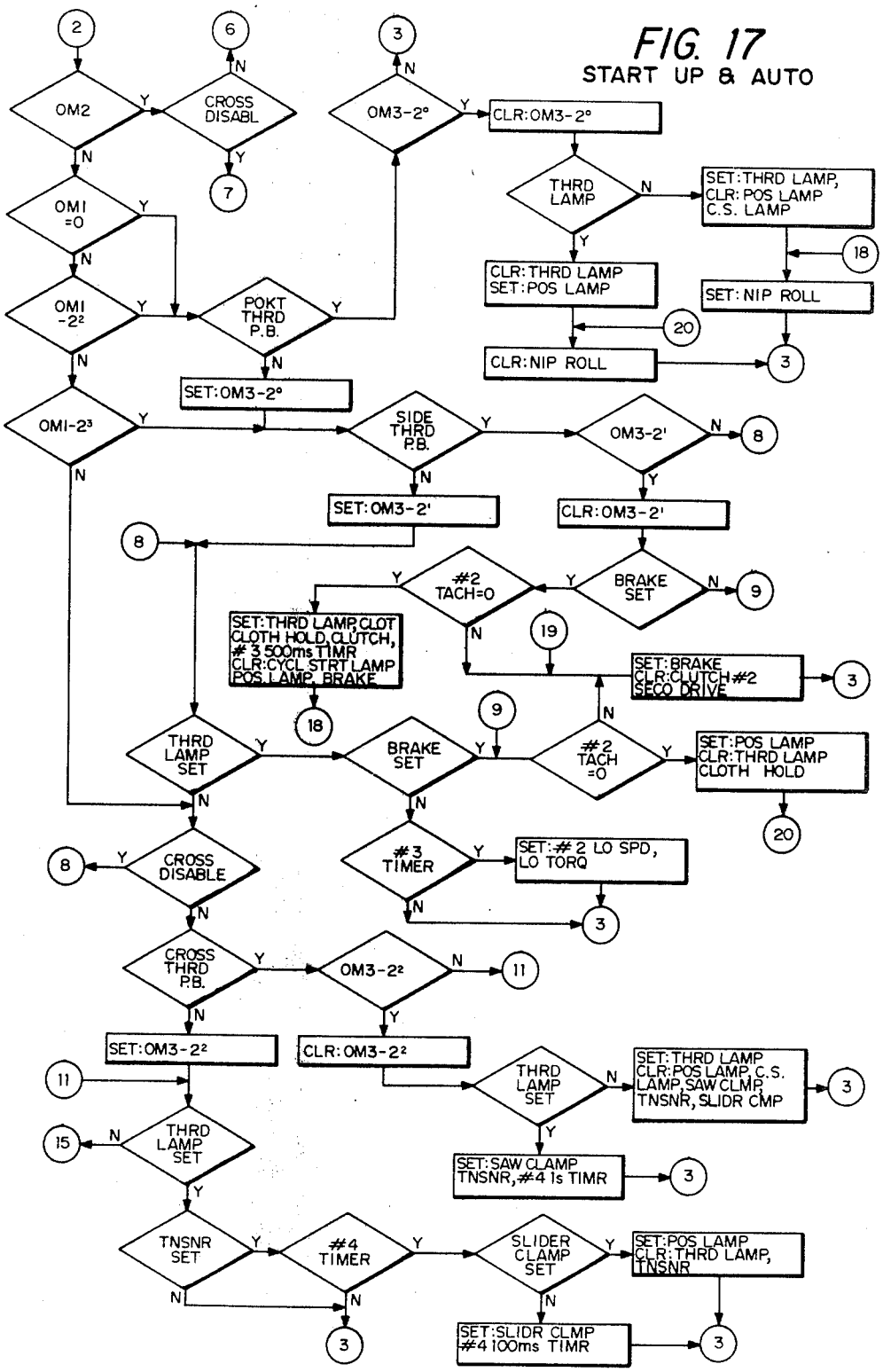
FIG. 17
START UP & AUTO
OM2
CROSS DISABL
OM3-2°
CLR:OM3-2°
THRD LAMP
SET:THRD LAMP, CLR: POS LAMP C.S. LAMP
CLR:THRD LAMP SET:POS LAMP
SET: NIP ROLL
CLR:NIP ROLL
OMI =0
OMI -2²
POKT THRD P.B.
SET:OM3-2°
OMI-2³
SIDE THRD P.B.
OM3-2'
SET:OM3-2'
CLR:OM3-2'
#2 TACH=0
BRAKE SET
SET:THRD LAMP,CLOT CLOTH HOLD,CLUTCH, #3 500ms TIMR CLR:CYCL STRT LAMP POS.LAMP, BRAKE
SET:BRAKE CLR:CLUTCH#2 SECO DRIVE
THRD LAMP SET
BRAKE SET
#2 TACH =0
SET:POS LAMP CLR:THRD LAMP CLOTH HOLD
CROSS DISABLE
#3 TIMER
SET:#2 LO SPD, LO TORQ
CROSS THRD P.B.
OM3-2²
SET:OM3-2²
CLR:OM3-2²
THRD LAMP SET
SET:THRD LAMP CLR:POS LAMP C.S. LAMP,SAW CLMP TNSNR, SLIDR CMP
SET:SAW CLAMP TNSNR,#4 1s TIMR
THRD LAMP SET
TNSNR SET
#4 TIMER
SLIDER CLAMP SET
SET:POS LAMP CLR:THRD LAMP, TNSNR
SET:SLIDR CLMP #4 100ms TIMR

START UP & AUTO

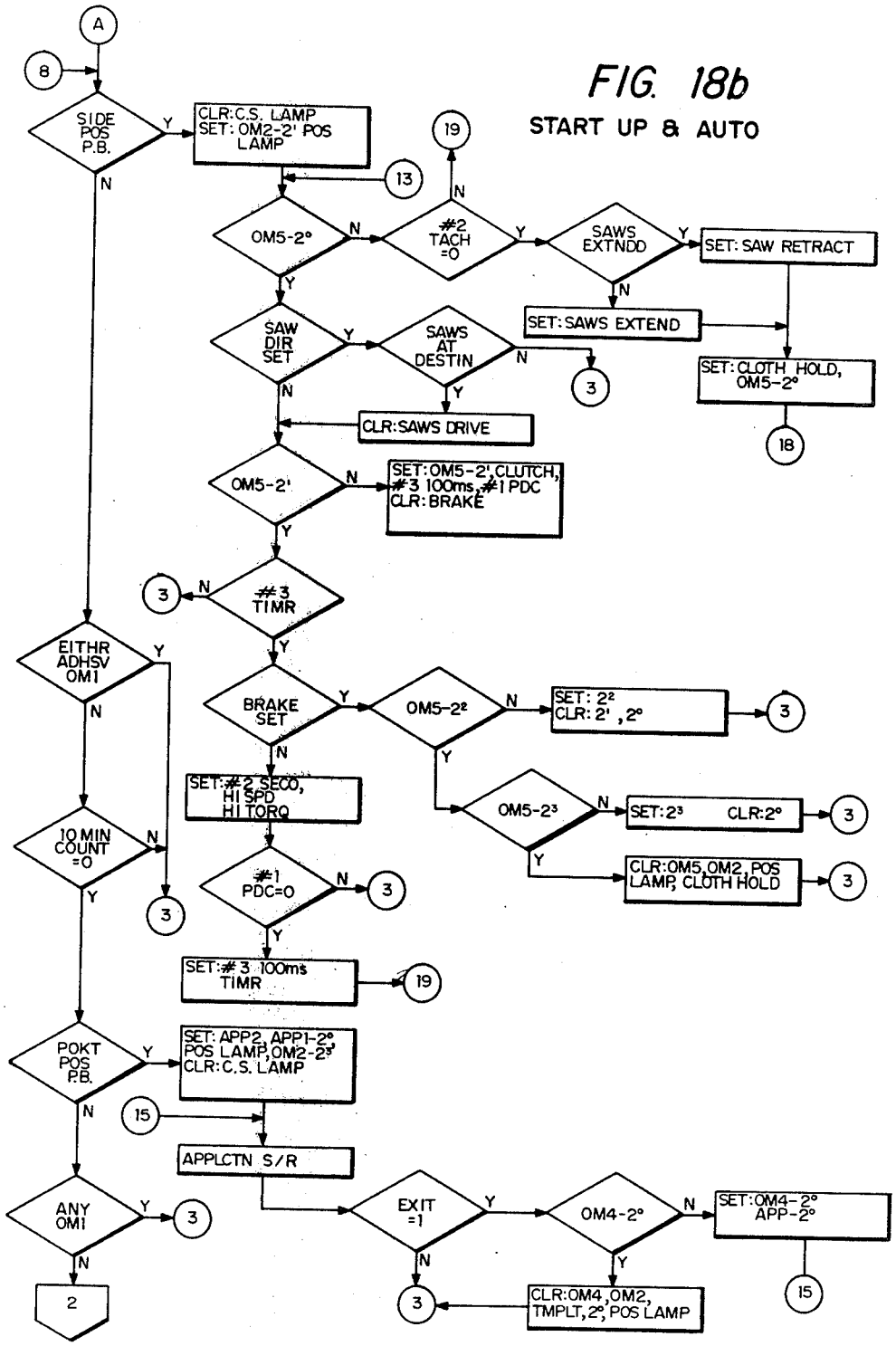
FIG. 18b
START UP & AUTO
A
8
SIDE POS P.B.
CLR:C.S. LAMP SET: OM2-2' POS LAMP
13
19
OM5-2°
#2 TACH =0
SAWS EXTNDD
SET: SAW RETRACT
SET: SAWS EXTEND
SAW DIR SET
SAWS AT DESTIN
3
SET: CLOTH HOLD, OM5-2°
18
CLR:SAWS DRIVE
OM5-2'
SET:OM5-2',CLUTCH, #3 100ms, #1 PDC CLR:BRAKE
#3 TIMR
EITHR ADHSV OM1
BRAKE SET
OM5-2²
SET: 2² CLR: 2' ,2°
SET:#2 SECO, HI SPD HI TORQ
OM5-2³
SET:2³ CLR:2°
CLR:OM5,OM2, POS LAMP, CLOTH HOLD
10 MIN COUNT =0
#1 PDC=0
SET:#3 100ms TIMR
POKT POS P.B.
SET: APP2, APP1-2° POS LAMP, OM2-2³ CLR:C.S. LAMP
15
APPLCTN S/R
ANY OM1
EXIT =1
OM4-2°
SET:OM4-2° APP-2°
CLR:OM4,OM2, TMPLT,2°, POS LAMP
2

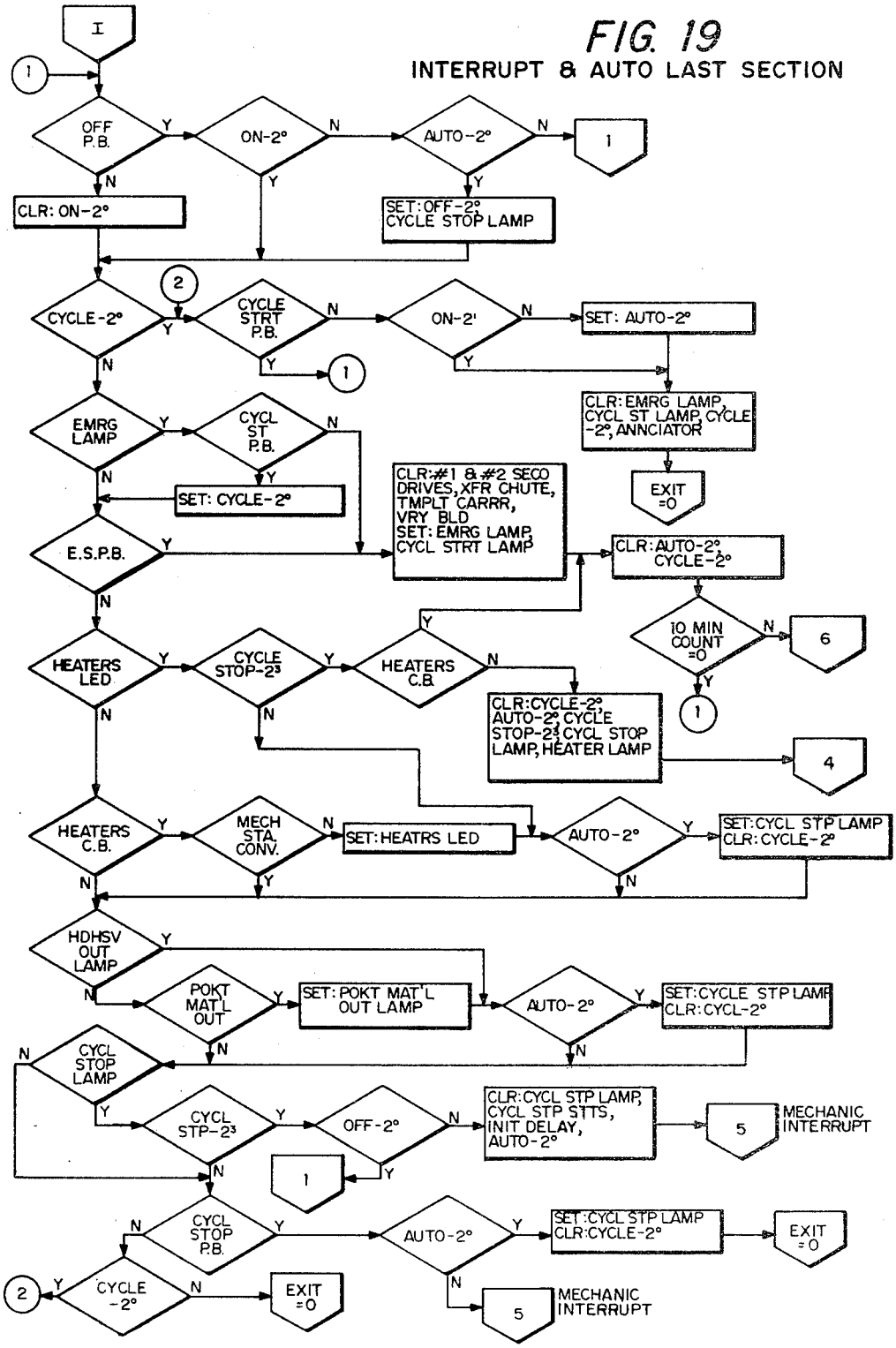
FIG. 19
INTERRUPT & AUTO LAST SECTION
I
1
OFF P.B.
ON-2°
AUTO-2°
CLR: ON-2°
SET: OFF-2° CYCLE STOP LAMP
CYCLE-2°
CYCLE STRT P.B.
ON-2'
SET: AUTO-2°
EMRG LAMP
CYCL ST P.B.
SET: CYCLE-2°
CLR: EMRG LAMP, CYCL ST LAMP, CYCLE -2°, ANNCIATOR
EXIT =0
CLR: #1 & #2 SECO DRIVES, XFR CHUTE, TMPLT CARRR, VRY BLD SET: EMRG LAMP, CYCL STRT LAMP
E.S.P.B.
CLR: AUTO-2°, CYCLE-2°
10 MIN COUNT =0
6
HEATERS LED
CYCLE STOP-2³
HEATERS C.B.
CLR: CYCLE-2°, AUTO-2°, CYCLE STOP-2³, CYCL STOP LAMP, HEATER LAMP
4
MECH STA. CONV.
SET: HEATRS LED
SET: CYCL STP LAMP CLR: CYCLE-2°
HDHSV OUT LAMP
POKT MAT'L OUT
SET: POKT MAT'L OUT LAMP
SET: CYCLE STP LAMP CLR: CYCL-2°
CYCL STOP LAMP
CYCL STP-2³
OFF-2°
CLR: CYCL STP LAMP, CYCL STP STTS, INIT DELAY, AUTO-2°
5
MECHANIC INTERRUPT
CYCL STOP P.B.
SET: CYCL STP LAMP CLR: CYCLE-2°
EXIT =0
2
Y
N

INTERRUPT & AUTO LAST SECTION

MECHANIC INTERRUPT

MECHANIC INTERRUPT

MECHANIC INTERRUPT

APPLICATION SEQUENCE

APPLICATION SEQUENCE

TEMPLATE/VERTICAL BLADE

TEMPLATE/VERTICAL BLADE

POCKET WHEEL

POCKET WHEEL

STACKER

APPARATUS AND METHOD FOR PREFABRICATING POCKETS

This is a division of application Ser. No. 971,622 filed Dec. 19, 1978, now U.S. Pat. No. 4,226,661.

BACKGROUND AND SUMMARY OF THE INVENTION

The present invention relates generally to an apparatus and method for manufacturing pockets, and more particularly relates to an apparatus and method for continuously prefabricating pockets for subsequent attachment to a garment.

In the manufacture of garments, pockets are provided chiefly as a convenient means for carrying useful articles. Such useful items may include, for example, a wallet, a handkerchief, currency, change, keys and the like. The pockets are integrated into the garment and take the general form of a pouch open at one end to permit easy access to the contents.

The two basic types of pockets utilized in the garment industry are the patch pocket and the standard pocket. The patch pocket is formed simply by connecting a peripheral portion of a layer or patch of material directly to the outside surface of a garment. The standard pocket, however, is of relatively more complex construction. In particular, construction of a standard pocket requires numerous manual operations including material cutting, folding, positioning, sewing, and trimming. These manual operations are both time consuming and costly in terms of labor and material expenditure.

In an attempt to solve some of these problems and thus reduce the overall cost of a garment, some efforts have been directed to the reduction of manufacturing steps through elimination or combination. For example, in co-pending application Ser. No. 905,054, now U.S. Pat. No. 4,156,293, issued May 29, 1979, assigned to the assignee hereof, there is shown an invention pertaining to the manual construction of individual pockets with the aid of adhesives. In another co-pending application assigned to the assignee hereof, application Ser. No. 845,450, now U.S. Pat. No. 4,214,933, issued July 29, 1980, there is shown an invention for the precise deposition of adhesive strips. However, heretofore there has not been available an apparatus which operates on a continuous basis to preform pockets ready for subsequent attachment to a garment.

The present invention comprises an apparatus and method for manufacturing pockets which overcomes the foregoing and other problems long since associated with the prior art. According to the broader aspects of the invention, pocket material of a predetermined width is directed lengthwise along a predetermined path. In one embodiment, ribbons from which are formed strips of adhesive are directed along other predetermined paths adjacent to the pocket material. Alternatively, adhesive can be extruded directly onto the pocket material. Following deposition of the adhesive at the desired locations, the pocket material is sheared to provide a length of material defining a pocket blank. Each pocket blank is then folded, adhesively secured in part, and collected for subsequent implantation into a garment. Use of the invention minimizes material waste, manual intervention and thus cost by achieving continuous prefabrication of pockets for garments.

In accordance with more specific aspects of the invention, a web of pocket material having a predetermined width is drawn from a supply roll and fed into the apparatus. The pocket material is engaged between feed and nip rollers for advancement first to an adhesive application station. In the preferred embodiment, strips of fusible adhesive formed from ribbons comprising a layer of adhesive on a backing are advanced into position adjacent the longitudinal edges of the pocket material. Cooperating movable heads, which are preferably heated, are then actuated to effect attachment of two adhesive strips along the edges of the pocket material. Preferably, a third strip of adhesive is similarly attached to the pocket material but in a transverse orientation.

In another embodiment, adhesive is applied in strips along each longitudinal edge, and preferably in a transverse strip also, by means of extrusion heads.

Following precise attachment of the adhesive, a predetermined length of the pocket material is then advanced past a cutter and into an aligning and folding station. Actuation of the cutter shears the pocket material to provide a pocket blank with adhesive attached thereto in predetermined locations. After proper alignment and positioning in one portion of the station, the pocket blank is then transferred to another portion of the station for folding. In the preferred construction, the pocket blank is first folded along the longitudinal edges during the transfer operation. The partly folded pocket blank is then pushed by a movable blade through a cooperating aperture. Actuation of the blade folds the pocket blank transversely with the adhesive edge strips inside and simultaneously advances the folded pocket blank to the activation station. If a less finished pocket is desired, the longitudinal edges of the pocket blank need not be folded prior to the transverse folding operation.

The activation station includes a rotatable wheel including a plurality of pocket receivers for receiving folded pocket blanks in succession from the movable blade. Presser bars, which are preferably heated, within each pocket receiver engage portions of the edges in the folded pocket blanks to secure at least the bottom section of the pockets. Upon each incremental rotation of the wheel, a vacant pocket receiver is indexed for chambering of another folded pocket blank as a prefabricated pocket is substantially simultaneously removed from another receiver for subsequent attachment to a garment.

DESCRIPTION OF THE DRAWINGS

A more complete understanding of the invention can be had by referring to the following Detailed Description in conjunction with the accompanying Drawings, wherein:

FIGS. 16–28 are flowcharts representing the logic utilized to control the invention; and FIG. 29 is a table explaining some of the abbreviations used in the flowcharts.

DETAILED DESCRIPTION

Figure 1:
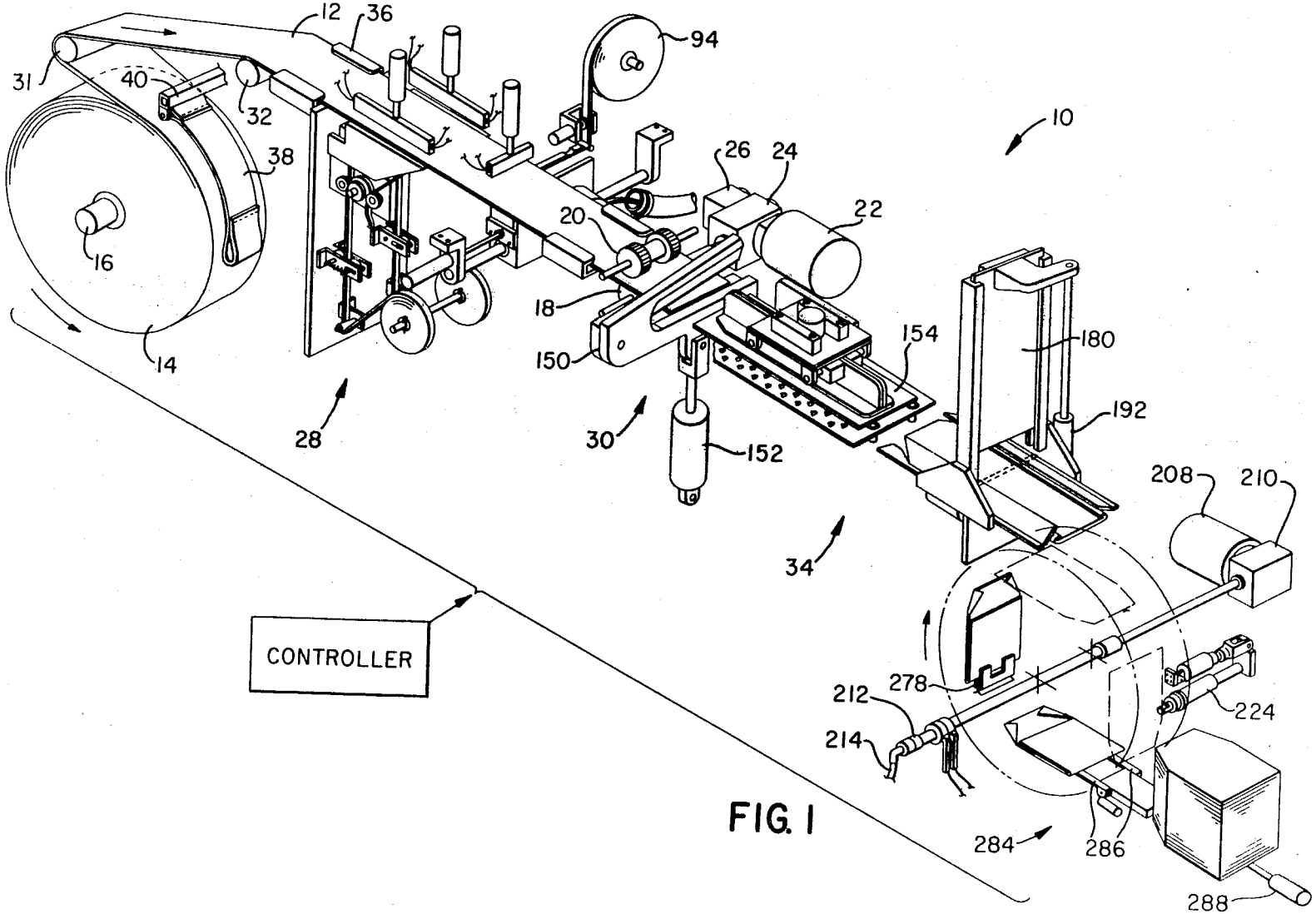
FIG. 1 is a perspective illustration of an apparatus for manufacturing pockets incorporating one embodiment of the invention.

Referring now to the Drawings wherein like reference numerals designate like or corresponding parts throughout the several views, and particularly referring to FIG. 1 thereof, there is shown an apparatus for manufacturing pockets 10 incorporating a first embodiment of the invention. The apparatus 10 can be utilized for rapid, continuous prefabrication of pockets for subsequent attachment to a garment. Apparatus 10 is particularly suited for prefabrication of pockets of the type described in application Ser. No. 905,054, now U.S. Pat. No. 4,156,293, issued May 29, 1979, the disclosure of which is hereby incorporated by reference. Apparatus 10 eliminates many timeconsuming and costly manual operations heretofore required in pocket construction, and operates automatically. A suitable controller, such as a preprogrammed microprocessor, is utilized to control operation of the invention.

In the practice of the invention, pocket material 12 is fed into apparatus 10 from a supply reel 14 rotatably carried on spindle 16. Material 12 is of predetermined width to allow fabrication of pockets having the desired size. Material 12 can comprise any natural or synthetic fabric or cloth suitable for use in pocket construction. It will be understood that the exact composition of pocket material 12 is not critical to the practice of the invention.

As is shown in FIG. 1, material 12 is engaged by rollers 18 and 20 for selective advancement through apparatus 10. Material 12 is nipped between feed roller 18 and idler roller 20. Preferably, rollers 18 and 20 are coated with a skid-resistant substance, such as rubber, so that no slippage occurs during advancement of material 12. Roller 18 is driven by electric motor 22 coupled through gear drive unit 24. A conventional rotary encoder 26 is connected to gear drive unit 24 and generates signals in proportion to the rotation of roller 18. Encoder 26 thus measures the amount of material 12 advanced by rollers 18 and 20. Motor 22 is responsive to encoder 26 so that predetermined lengths of material 12 can be precisely fed by incremental advancements through apparatus 10.

In accordance with the preferred construction, rollers 18 and 20 are located between adhesive application station 28 and cutter 30. Aligning and folding station 34 is located beyond cutter 30. Material 12 is thus drawn from reel 14 around guide rollers 31 and 32, between guides 36 and into station 28 simultaneously with the advancement of the leading end of material 12 past cutter 30 into the first part of station 34. The reverse side of material 12 is down during direction through apparatus 10. Drag strap 38 supported from bracket 40 and contacting reel 14 can be provded, if desired, to reduce slackening of material 12 caused by intermittent withdrawal from reel 14.

Figures 2, 3:
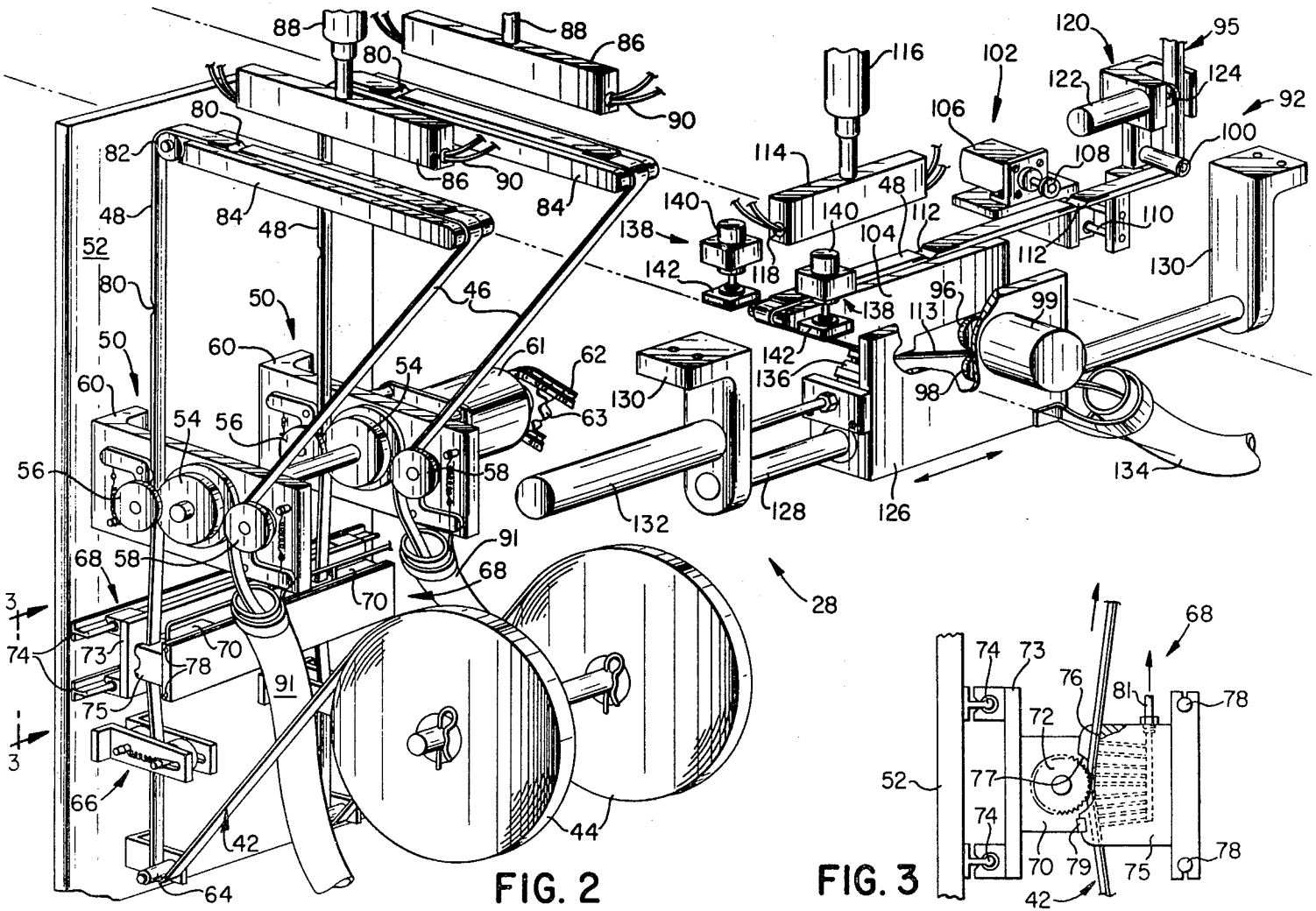
FIG. 2 is a perspective illustration of the adhesive applicator portion of the embodiment of FIG. 1 in which certain parts have been broken away to illustrate more clearly certain features of the invention.
FIG. 3 is a partial side view of FIG. 2, with certain portions broken away.

Referring now to FIG. 2, there is shown adhesive application station 28 at which predetermined strips of fusible adhesive material are attached to material 12. Adhesive ribbons 42, a quantity of which is carried on each supply reel 44, are utilized. Ribbon 42 comprises a backing 46 coated on one side with a layer of adhesive 48. Backing 46 can be of paper, for example, and is preferably at least as wide as adhesive 48. Nylon, polyamide, polyester, or other fusible substances characterized by temporary conversion to a plastic state from a solid state upon the application of suitable energy can constitute adhesive 48. Ribbon 42 may be of the type manufactured by General Fabric Fusing Company of Cincinnati, Ohio.

In particular, station 28 includes a pair of applicator assemblies 50 secured to a frame 52 beneath the path of material 12, which path is designated by phantom lines in FIG. 2. Assemblies 50 draw adhesive ribbons 42 from separate supply reels 44. Each assembly 50 includes a feed roller 54 and a pair of idler rollers 56 and 58 disposed on substantially opposite sides thereof. Rollers 54, 56 and 58 are mounted for rotation about substantially horizontal axes in extensions 60 secured to frame 52. In accordance with the preferred construction, each roller 56 and 58 is carried on a pivotal arm for biased engagement with the respective feed roller 54. A clutch/brake 61 is attached as shown to the outer end of a drive shaft to which feed rollers 54 are commonly affixed. A chain 62 is constrained for rotation around sprocket 63 of clutch/brake 61 and another sprocket (not shown) secured to feed roller 18. The clutch/brake 61 is preferably of the electromechanical type and is responsive to encoder 26 for selectively rotating feed rollers 54 or arresting rotation of rollers 54.

It will thus be appreciated that ribbons 42 are advanced in predetermined increments simultaneously with advancement of material 12. If desired, a motor synchronous with pocket material feed roller 18 can be connected directly to adhesive ribbon feed rollers 54 in place of cluth/brake 61, sprocket 63, and chain 62. Ribbon 42 in each assembly 50 is frictionally engaged between rollers 54 and 56 and drawn from reel 44 around guide roller 64 and between tension rollers 66. Rollers 66 are biased together so that each ribbon 42 is taut prior to contacting rollers 54 and 56.

Referring to FIGS. 2 and 3, a cutter 68 is positioned adjacent the path of each ribbon 42 between rollers 66, and rollers 54 and 56. Cutter 68 includes an electric motor 70 driving a small milling wheel 72. Each motor 70 and milling wheel 72 is supported by a platform 73, which is mounted for movement on tracks 74. A stationary anvil 75 is positioned next to each cutter 68 and along the paths of ribbons 42. The anvils 75 are best shown in FIG. 3. Each anvil 75 includes a convex face having orthogonal slots 76 and 77 machined therein. The slot 76 comprises a guideway for ribbon 42. The slot 77 comprises a guideway for milling wheel 72. According to the preferred construction, anvils 75 are clampingly secured on rods 78 extending across frame 52 in spaced relationship. A keeper 79 for ribbon 42 can be provided on each anvil 75, if desired. A double-acting cylinder (not shown) selectively reciprocates both platforms 73 causing the rotating milling wheels 72 in cutters 68 to simultaneously translate through slots 77. Each ribbon 42 is thus engaged between the respective milling wheel 72 and anvil 75 to produce a separation 80 in the adhesive 48 only. It will be understood that backing 46 remains intact and is not severed. This is a significant feature of the invention. Consequently, predetermined adhesive strips with separations 80 therebetween are produced from ribbon 42 and carried by backing 46.

If desired, the anvils 75 in cutters 68 can be provided with a vacuum port 81. The vacuum port 81 connects to a crossbore and a plurality of bores opening into slot 76. For clarity, the crossbore and bores with each anvil 75 are depicted with hidden lines in FIG. 3. Evacuation of air through port 81 assures positive engagement between each ribbon 42 and anvil 75, and causes a drag or brake force on the ribbon. It will be appreciated that the amount of drag induced on ribbons 42 can be accurately controlled with the vacuum pressure maintained at ports 81, thereby enhancing the operational precision of the ribbon applicator assemblies 50.

Ribbons 42 are then advanced, preferably around guide rollers 82, to position adhesive strips on supports 84, one of which is provided for each applicator assembly 50. Supports 84 are positioned in spaced relationship longitudinally beneath the edges of material 12. In accordance with the preferred construction, cutters 68 are positioned along the paths of ribbons 42 a distance from supports 84 corresponding to an integer multiple of the desired length for the adhesive strips. Cutters 68 are actuated between advancements of ribbons 42 to provide separations 80 at regular intervals in adhesive 48. Two precise strips of adhesive are thus positioned by rollers 54 adjacent the edges of material 12 for attachment thereto.

Each applicator assembly 50 includes a cooperating head 86 disposed above support 84 and mounted for reciprocal movement for engagement therewith. Each elongate head 86 is coupled to a double-acting cylinder 88. If desired, both of heads 86 can be actuated in unison by a common cylinder. Heads 86 can be constructed of any suitable material, such as steel, molded rubber, or aluminum. Preferably, each head 86 includes means for maintenance thereof at an elevated temperature sufficient to activate adhesive 48. For example, each head 86 could include an ultrasonic or radio frequency source. Alternatively, an external source of radiation or heat could be utilized. In accordance with the preferred construction, an electrical resistance element 90 is provided within each head 86. Electrical resistance element 90 is wired to a suitable source of electricity to raise the temperature across the face of head 86 so that upon engagement with material 12, the underlying adhesive strip is at least partially converted to a plastic state from a solid state. Longitudinal strips of adhesive 48 are thus applied along the edges of the reverse side of material 12.

It will be apparent that when material 12 is advanced to station 28, adhesive strips carried on backings 46 are positioned on supports 84 beneath material 12. Heads 86 located above material 12 are then cycled to press the adhesive strip located along each longitudinal edge of material 12 into engagement therewith. The temperature and duration of engagement is sufficient to partially convert adhesive 48 from a solid state to a plastic state, thereby attaching the strips of adhesive to material 12. At this point, it will be understood that the strips of adhesive are secured to material 12 and backing 46. Therefore, backing 46 must be separated from each secured adhesive strip to allow advancement of material 12. To accomplish this, adhesive ribbon 42 is advanced substantially simultaneously with the advancement of material 12. Backing 46 extends over the sharply rounded forward edge of support 84 and is drawn downward between rollers 54 and 58. Consequently, as material 12 is advanced, backing 46 is concurrently stripped away from each deposited adhesive strip as the next strips of adhesive are positioned on supports 84.

According to the preferred construction of the invention, driven rollers 54 are of dual diameter construction. Adhesive ribbon 42 is engaged between roller 56 and the relatively smaller diameter portion of each feed roller 54. Backing 46 is engaged between roller 58 and the relatively larger diameter portion of each roller 54. This causes a slight overdrive effect whereby adhesive ribbon 42 and backing 46 are maintained in tension around rollers 82 and supports 84 by feed roller 54. This improves the precision with which the strips of adhesive 48 are positioned on supports 84 for deposition. Thus, after deposition and upon advancement of material 12, taut backing 46 is drawn between rollers 54 and 58 for instant disengagement. Another strip of adhesive 48 is thus positioned on each support 84 as another section of material 12 is placed thereover. If desired, a suction tube 91 connected to a vacuum system (not shown) can be positioned beneath rollers 54 and 58 to collect the separated backing 46.

FIG. 2 also shows applicator assembly 92 which can be utilized together with assemblies 50 at station 28. Assembly 92 operates independently of but substantially concurrently with assemblies 50 to apply a strip of adhesive 48 in a generally transverse direction to the reverse side of material 12. According to the preferred construction, assembly 92 is positioned downstream of assemblies 50. However, it will be understood that assembly 92 can be located along the path of material 12 on either side of assemblies 50.

In assembly 92, ribbon 95, which is identical to ribbon 42 hereinbefore described, is frictionally engaged between feed roller 96 and idler roller 98. Electric motor 99 is drivingly connected to roller 96. Ribbon 95 is drawn from reel 94, shown in FIG. 1, and directed around guide roller 100 past cutter 102 and toward support 104. Cutter 102, which is similar to cutters 68 described above, includes an electric motor 106 driving a small milling wheel 108. Cutter 102 is transported across the path of ribbon 95 on guides 110. The ribbon 95 is guided adjacent to cutter 102 by an anvil, similar to anvils 77 hereinbefore described, but omitted from assembly 92 for clarity. A double-acting cylinder (not shown) causes milling wheel 108 to reciprocate across ribbon 95 so that only adhesive is severed upon traversal of the ribbon by wheel 108. In accordance with the preferred construction, cutter 102 is positioned along the path of ribbon 95 a distance from support 104 corresponding to an integer multiple of the desired length for the strips of adhesive. Cutter 102 is actuated between advancements of ribbon 95 to provide separations 112 at regular intervals in the adhesive layer. In this manner, precise adhesive strips carried on backing 113 are formed from ribbon 95.

Head 114 is actuated after a strip of adhesive has been advanced into position between the surface of support 104 and reverse side of material 12. Elongate head 114 is disposed immediately above support 104. Double-acting cylinder 116 is coupled to head 114 for selective reciprocation thereof relative to support 104. Head 114 is constructed in a fashion similar to that of heads 86, hereinbefore described. Preferably, head 114 includes means for maintenance thereof at a temperature elevated sufficiently to activate the adhesive on backing 113. If desired, head 114 could include an ultrasonic source (not shown) to effect activation of the adhesive strip upon engagement therewith. Alternatively, an external source of radiation or heat could be utilized. In accordance with the preferred construction, electrical resistance element 118 wired to a suitable source of electricity is provided within head 114. Element 118 raises the temperature across the face of head 114 so that upon engagement with material 12, the underlying transverse strip of adhesive is at least partially converted from a solid state to a plastic state, attaching it to one side of material 12.

At this point, the transverse adhesive strip is secured to material 12 and backing 113. Before either ribbon 95 or material 12 can be advanced to their next positions, backing 113 must be detached from the deposited adhesive strip. First, ribbon clamp 120 is actuated to immobilize adhesive ribbon 95. Clamp 120 includes a double-acting cylinder 122 coupled to a pad 124 for clamping ribbon 95 against cooperating structure. Other types of suitable clamping devices can be utilized, if desired. After immobilization of ribbon 95, support 104 is withdrawn from the deposited transverse strip of adhesive. Support 104 is secured to carriage 126 which is mounted for sliding movement on rail 128. Rail 128 extends beneath and across the path of material 12 between brackets 130. Actuation of double-acting cylinder 132 causes traversal of carriage 126 beneath material 12, whereby backing 113 is drawn between rollers 96 and 98 and thus stripped away from the deposited adhesive strip. It will be understood that the combined actions of carriage 126 and rollers 96 and 98 effect a clean and crisp disconnection of backing 113 from the deposited transverse strip of adhesive. If desired, suction tube 134 leading to a vacuum system (not shown) can be positioned near rollers 96 and 98 for collection of separated backing 113.

In preparation for the next advancement of material 12, support 104 is then repositioned as shown in full lines in FIG. 2. Ribbon clamp 120 is first disengaged to allow movement of ribbon 42. Backing clamp 136 is actuated before the return of carriage 126 to immobilize backing 113 against a portion of support 104. Clamp 136 is mounted on carriage 126 and comprises a double-acting cylinder coupled to a pad, although other suitable types of clamping devices could be utilized if desired. Thus with backing 113 immobilized, ribbon 95 is advanced with the return of carriage 126 and support 104. In accordance with the preferred construction, the stroke of cylinder 132 corresponds to the desired length of adhesive strips formed from ribbon 95. It will thus be appreciated that operation of carriage 126 first strips backing 113 from the deposited strip of adhesive and then positions the next adhesive strip for deposition.

Preferably, material clamps 138 are utilized in conjunction with assembly 92 to secure material 12 during movement of carriage 126. In the preferred construction of apparatus 10, two material clamps 138 are positioned above the path of material 12 and across from support 104. Each clamp 138 comprises a double acting cylinder 140 coupled to a foot 142 for selectively clamping material 12 against cooperating structure. Clamps 138 are operated in unison during movement of support 104. It will thus be appreciated that actuation of clamps 138 prevents lateral displacement of material 12 as the backing 113 is stripped away from the transverse strip of adhesive. Clamps 138, of course, are disengaged during advancement of material 12.

Therefore, at station 28 adhesive strips are applied along the longitudinal edges of material 12 by assemblies 50. These edge strips of adhesive are employed subsequently to adhesively secure the edges of the pocket, as will be described hereinafter. Station 28 can also include assembly 92 for applying to material 12 a generally transverse adhesive strip, which can be subsequently used in other pocket construction steps. For example, such a transverse strip of adhesive can be used to adhesively secure a prefabricated pocket to a garment. It will be understood that the use of a milling wheel in assemblies 50 and 92 comprises a significant feature of the present invention. Predetermined strips of adhesive are generated from continuous lengths of adhesive ribbons 42 and 95 transported on backings. Most importantly, substantial separations or gaps are provided between successive adhesive strips thereby creating a transition zone between the adhesive strip being activated and the next strip to be activated. Consequently, upon retraction of the respective head there is no taffy effect of stringy material pulling between activated and non-activated zones of adhesive. The precision with which adhesive strips are attached to material 12 is therefore enhanced because the ends of each strip remain well defined. Backings 46 and 113 are then crisply stripped away from the deposited adhesive strip concurrently with advancement of the next strip to be deposited on material 12.

With reference again to FIG. 1, material 12 is then advanced from station 28 through a shear or cutter 30 and into aligning and folding station 34. Cutter 30 comprises fixed and movable blades 150 between which material 12 is directed. After a predetermined length of material 12 has been advanced past cutter 30, double-acting cylinder 152 coupled to one of blades 150 is cycled to shear a pocket blank 154 from material 12. Pocket blank 154 includes strips of adhesive 48 positioned at least along each longitudinal edge thereof. In accordance with the preferred construction, cutter 30 is positioned along the path of material 12 an integer multiple of the desired length of pocket blank 154. It will be apparent that this enhances the speed of the pocket prefabrication operation. The proper length of material 12 is advanced past cutter 30 simultaneously with the advancement of a following section of material 12 into adhesive application station 28.

Figure 4:
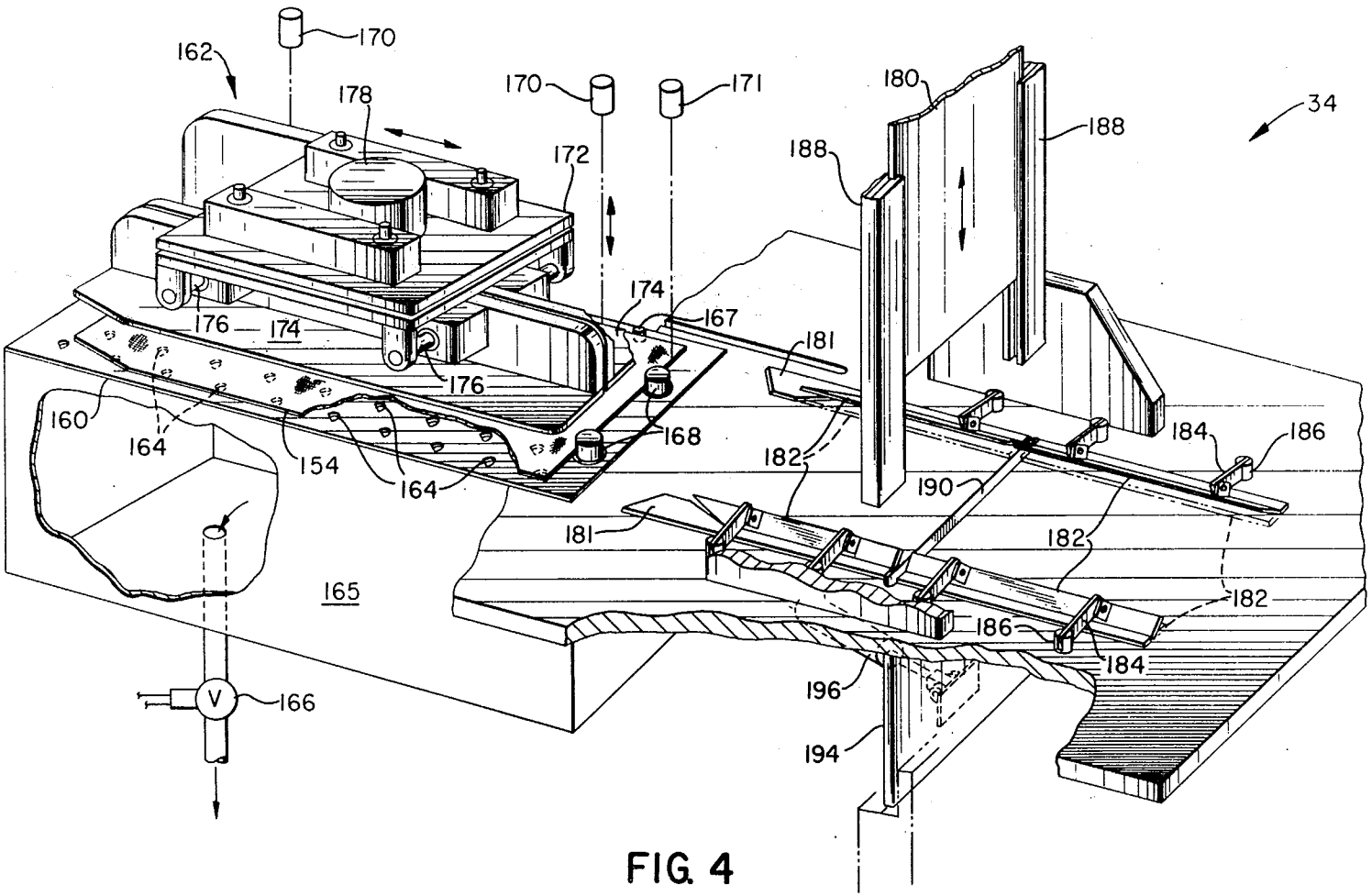
FIG. 4 is a perspective illustration of the aligning and folding portion of the invention in which certain parts have been broken away to illustrate more clearly certain features of the invention.

Referring now to FIG. 4, there is shown aligning and folding station 34 which receives pocket blank 154 from cutter 30. In particular, pocket blank 154 is received between surface 160 and carriage 162. A plurality of ports 164 are provided in surface 160 for communication with a plenum chamber 165 below. Conventional air supply and vacuum lines are connected to the plenum chamber 165 via a suitable 3-way valve 166. In actual practice, a low pressure medium volume air supply has been found satisfactory. Air can thus be caused to enter or leave ports 164. Consequently, either an air cushion or a vacuum effect can be created between surface 160 and carriage 162. This selective air flow is employed to properly align pocket blank 154 prior to folding.

Upon receipt of pocket blank 154 between surface 160 and carriage 162, a positive air flow from ports 164 creates an air cushion. Ports 164 are angled so that pocket blank 154 is carried into engagement with two pairs of stops 167 and 168. Stops 167, only one of which is shown, are fixed to surface 160 for engagement with a lengthwise edge of pocket blank 154. Retractable stops 168 are provided in surface 160 for engagement with the forward end of pocket blank 154. Stops 168 can be selectively retracted by any suitable means, such as double-acting cylinders. In accordance with the preferred construction, stops 167 and 168 are circular to minimize disturbance of the air flow between carriage 162 and surface 160, so that pocket blank 154 can be carried into positive engagement with the stops.

Proper alignment of the pocket blank 154 is sensed by scanners or lamp/photosensors 170 and 171. A pair of lamp/photosensors 170 are positioned in spaced relationship above the edge of surface 160. The lamp/photosensor 171 is positioned above surface 160 at the front end thereof. The lamp/photosensors 170 and 171 project beams onto surface 160, which reflects the beams back to the respective lamp/photosensors. For purposes of illustration, lamp/photosensors 170 and 171 are shown in exploded positions in FIG. 4. The beams of lamp/photosensors 170 are broken only when the edge of the pocket blank 154 is engaged with stops 167. The beam of lamp/photosensor 171 is broken only when the forward end of pocket blank 154 contacts stops 168. Consequently, interruption of the beams of lamp/photosensors 170 and 171 indicates that a pocket blank 154 has been properly aligned. Proper alignment of a pocket blank 154 has not occurred if the beam of lamp/photosensors 171 or one of the beams of lamp/photosensors 170 is not interrupted.

When the proper location of pocket blank 154 against stops 167 and 168 has been sensed, the air flow through ports 164 is reversed by actuation of valve 166. A vacuum effect is thus created and pocket blank 154 is pulled downward on surface 160. Substantially simultaneously, carriage 162 is displaced downwardly to press the pocket blank against surface 160. Carriage 162 includes a frame 172 which is mounted for displacement along the path of material 12. Carriage 162 can be displaced by any suitable means, such as a double-acting cylinder (not shown). Split template sections 174 are supported beneath frame 172. Template sections 174 are mounted for transverse movement on bars 176 extending between brackets secured to frame 172. Template sections 174 can be selectively displaced outwardly from the position shown in full lines in FIG. 4 by double-acting cylinder 178. The overall length of template sections 174 is substantially identical to the length of pocket blank 154. However, in the retracted position shown in FIG. 4, the combined width of template sections 174 is relatively less than that of pocket blank 154 so that when carriage 162 frictionally engages the underlying pocket blank, template sections 174 are oriented centrally with respect thereto.

After retraction of stops 168, carriage 162 transfers pocket blank 154 from the positioning portion to the folding portion of station 34. Forward displacement of carriage 162 advances the pocket blank 154 beneath folder blade 180 and between fixed guides 181 and edge clamps 182. Each edge clamp 182 comprises two pairs of longitudinal sections which operate in unison. Links 184 interconnect clamps 182 and posts 186. Conventional actuators, such as a double-acting cylinder (not shown), are employed to translate posts 186 so as to effect a pivotal, clamping action with clamps 182. Clamps 182 are displaced upwardly as shown with full lines in FIG. 4 to receive carriage 162 and pocket blank 154 therebetween. Before extension of template sections 174, pocket blank 154 resembles a shallow, flattened U with the longitudinal edges overlying clamps 182.

Template portions 174 are then extended outwardly beneath clamps 182. This causes a gentle rolling effect, folding the longitudinal edge portions of pocket blank 154 inwardly with the strips of adhesive 48 on the edges facing upward. It will be understood that extension of template portions 174 simultaneously eliminates any wrinkles in pocket blank 154 while causing the edges to be folded. As template portions 174 are retracted, clamps 182 are actuated downwardly to the position shown in phantom lines in FIG. 4. Clamps 182 are brought into biased engagement with the folded edges of pocket blank 154 to preserve the folds after retraction of template portions 174. Carriage 162 is then returned to the position shown in full lines in FIG. 4 for alignment and transfer of the next pocket blank. FIG. 1 illustrates a pocket blank 154 after folding of the edges.

Referring still to FIG. 4, the partly folded pocket blank 154 is then folded transversely by blade 180. Mounted for vertical sliding movement between guides 188, blade 180 is positioned for registry with slot 190. Upon selective actuation of double-acting cylinder 192 shown in FIG. 1, blade 180 descends to engage and push pocket blank 154 through slot 190. Preferably, the cooperating peripheries of blade 180 and slot 190 are rounded or curved to enhance smooth flow of pocket blank 154 into chute 194 extending beneath slot 190. Chute 194 is coupled to double-acting cylinder 196 for selective pivotal alignment with blade 180. Consequently, pocket blank 154 is advanced by blade 180 and simultaneously formed into two pocket panels interconnected by a fold.

It will be understood that the operation of station 34 comprises a significant feature of the present invention. A flat pocket blank 154 having strips of adhesive 48 along at least the longitudinal edges of the reverse side of the pocket blank is received and aligned for transfer. Carriage 162 positions the flat pocket blank 154 within folding structure. The edges of pocket blank 154 are then folded inward to position each longitudinal edge strip of adhesive 48 in the obverse direction. The edge folds are maintained as the pocket blank 154 is then simultaneously folded transversely and advanced. This forms pocket blank 154 into two, parallel pocket panels interconnected at one end with a fold with the folded edge portions inside.

Figure 5:
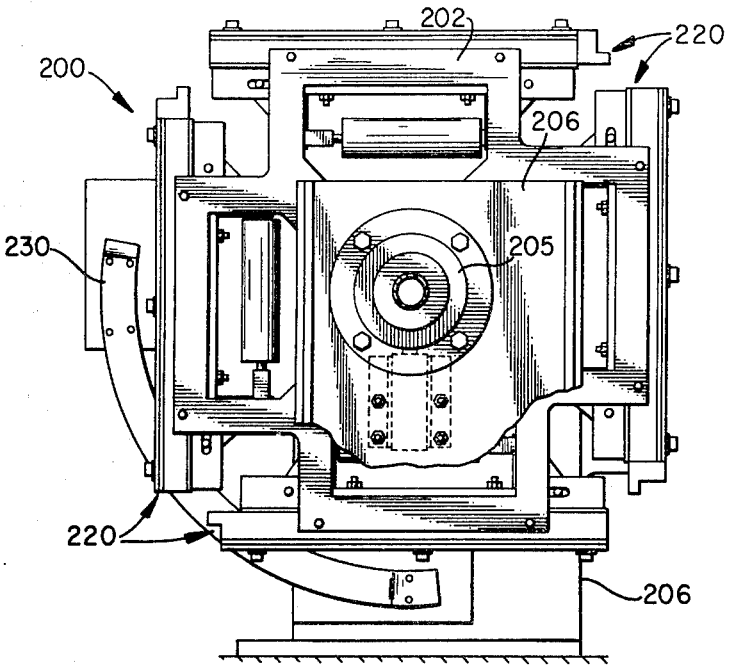
FIGS. 5 and 6 are side and front elevational views, respectively, of the revolving pocket wheel portion of the invention in which certain parts have been broken away to illustrate more clearly certain features of the invention.
Figure 6:
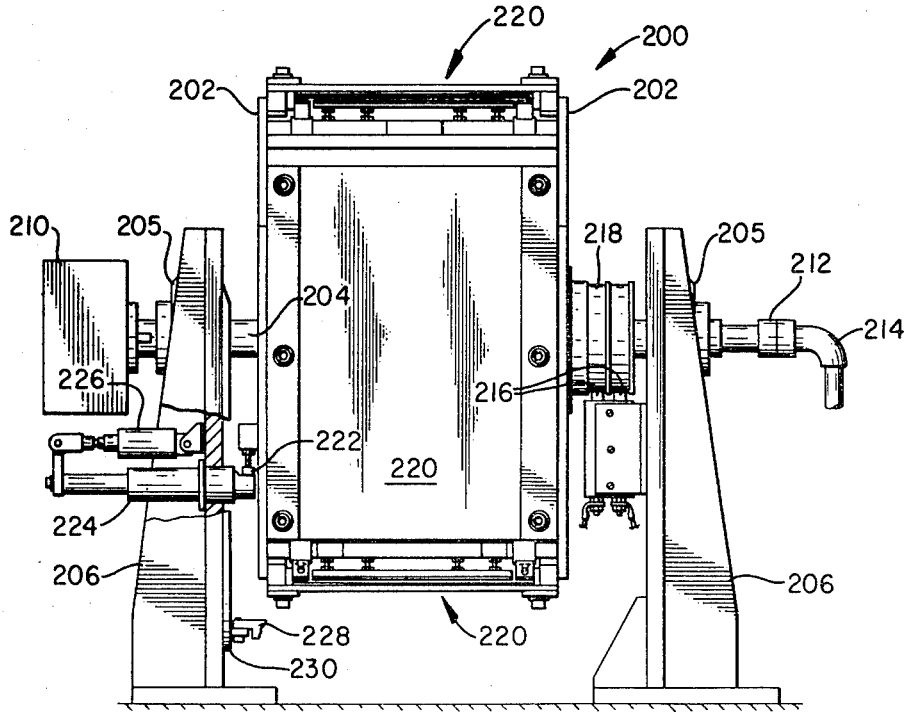

Referring now to FIGS. 5 and 6 in conjunction with FIG. 1, there is shown pocket wheel 200 which receives the folded pocket blanks 154 from station 34. Wheel 200 includes a pair of side members 202 attached to shaft 204 in spaced relationship. Shaft 204 is journaled for rotation about a horizontal axis between bearings 205 in frames 206. Wheel 200 is rotatably driven in a clockwise direction when viewing FIG. 5 by motor 208, shown in FIG. 1, through gear drive unit 210 coupled to one end of shaft 204. In accordance with the preferred construction, motor 208 is a DC type motor which constantly drives shaft 204. Coupled to the other end of shaft 204 is a rotary union 212. A bore extends within shaft 204 from rotary union 212 to a point inside wheel 200. Conduit 214 interconnects union 212 with a suitable pneumatic source to furnish power to pressure actuated devices on wheel 200. Additionally, brushes 216 wired to a suitable source of electricity engage slip rings 218 on shaft 204 to provide power to electrically actuated devices on wheel 200. A cover (not shown) preferably surrounds brushes 216 and rings 218 to prevent contact with electrical conductors.

Pocket wheel 200 further includes pocket receivers 220 mounted at equal intervals between side members 202. In accordance with the preferred construction, four pocket receivers 220 extend at 90 degree intervals between members 202 and at identical radii from shaft 204. Each receiver 220 includes a corresponding step 222 secured to wheel 200 for engagement with pin 224 slidably mounted in frame 206. Double-acting cylinder 226 selectively extends pin 224 to positively engage a stop 222 and thus interrupt the rotation of wheel 200. In accordance with the preferred construction, each stop 222 comprises a threadably mounted foot so that each corresponding pocket receiver 220 can be precisely indexed with reference to slot 190 and chute 194. Each pocket receiver 220 also includes a cam follower 228 mounted on wheel 200 for engagement with camming surface 230 fixed to frame 206. Each cam follower 228 engages surface 230 during a predetermined rotational portion of wheel 200 corresponding to preselected positioning of the corresponding receiver 220. As will be hereinafter described, surface 230 and cam followers 228 are utilized to control components within each pocket receiver 220.

Figure 7:
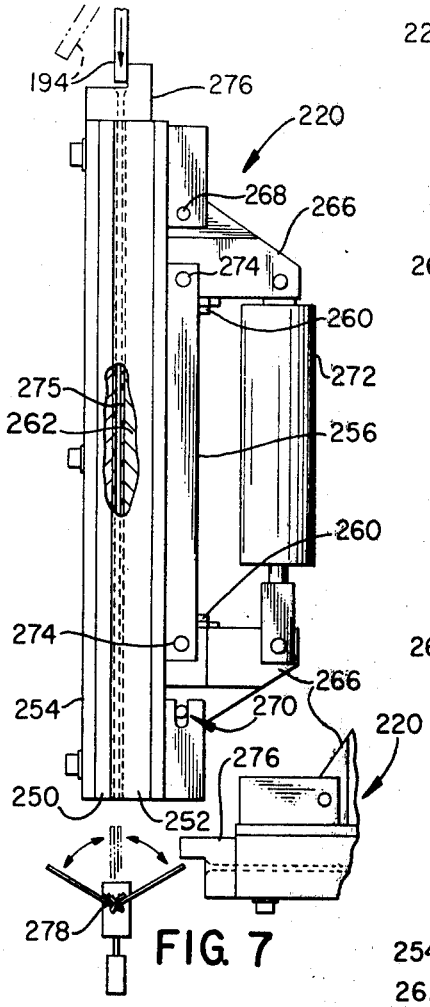
FIG. 7 is a side elevational view of a pocket receiver in the pocket wheel of the invention in which certain parts have been broken away to illustrate more clearly certain features of the invention.
Figure 8:
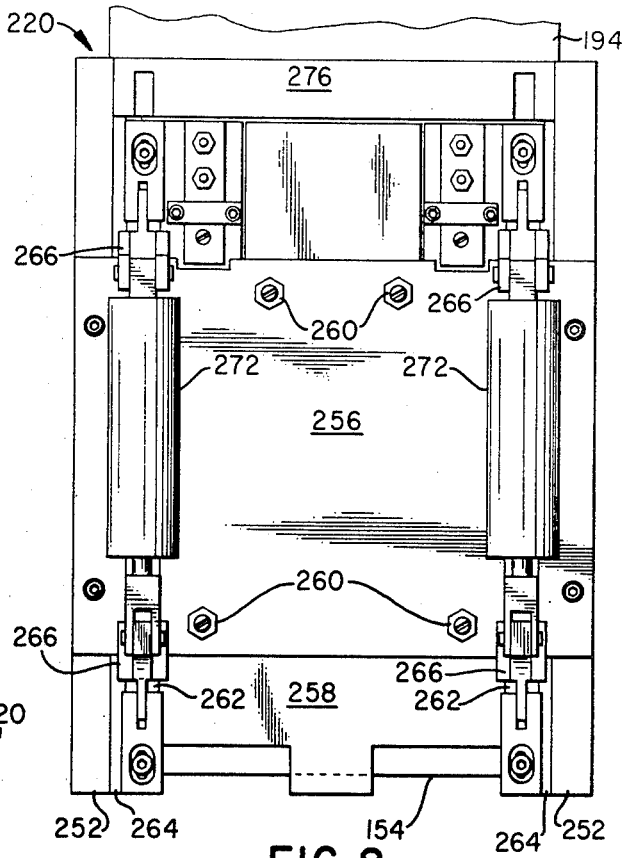
FIGS. 8 and 9 are front and bottom views, respectively, of the pocket receiver shown in FIG. 7.
Figure 9:
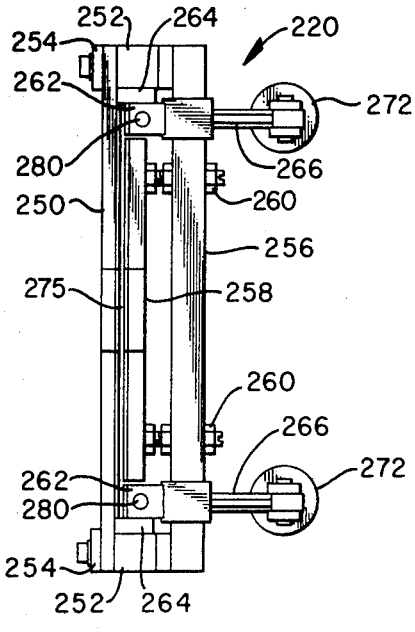

Having reference to FIGS. 7, 8 and 9, there is shown the construction of a pocket receiver 220. Each pocket receiver 220 includes a base plate 250 clamped between two pairs of side pieces 252 and 254. Inner side pieces 252 and outer side pieces 254 extend along the longitudinal edges of plate 250. According to the preferred construction, plate 250 is formed of insulating material and side pieces 252 and 254 are constructed of aluminum. A bridge 256, which is also preferably constructed of aluminum is secured between inner side pieces 252 in spaced relationship with plate 250. It will thus be understood that plate 250, side pieces 252 and 254, and bridge 256 are all fixed members comprising a frame which is rigidly secured between side members 202 of pocket wheel 200.

Inner plate 258 is supported from bridge 256 in parallel, spaced relationship with base plate 250. Preferably, inner plate 258 is adjustably secured to bridge 256 with threaded studs 260. A presser bar 262 is positioned adjacent each longitudinal edge of inner plate 258. TEFLON spacers 264 are positioned between each presser bar 262 and the adjacent inner side piece 252. Each presser bar 262 is supported for movement relative to base plate 250 on a pair of cranks 266. In accordance with the preferred construction, one end of each bar 262 is pivotally secured to one crank 266 by means of pin 268, while the other end of bar 262 is pivotally secured to the other crank 266 with a pin and slot arrangement 270. A double-acting pneumatic cylinder 272 is coupled between each pair of cranks 266. It will thus be apparent that actuation of cylinders 272 fulcrums cranks 266 about pins 274 causing bars 262 to engage underlying plate 250. According to the preferred construction, cylinder 272 and bars 262 are coupled to cranks 266 so as to provide a mechanical advantage of 1.5:1. In this manner, the desired compression between bars 262 and plate 250 is achieved with relatively small cylinders 272. Plates 25 and 258 and bars 262 thus define a slot 275 for receiving a folded pocket blank 154 from station 34. In the preferred construction, the interior surfaces of plates 250 and 258 and bars 262 include a smooth coating of non-stick material, such as TEFLON, to facilitate reception of the pocket blank 154 and to prevent undesirable adherence therewith.

The operation of pocket wheel 200 proceeds as follows. Rotation of wheel 200 in a clockwise direction is interrupted by pin 224 to position a pocket receiver 220 beneath slot 190. Chute 194, which is pivotally actuated out of interference during rotation of wheel 200, is pivoted into alignment between slot 190 and pocket receiver 220. Preferably, each receiver 220 includes an inlet piece 276 with an upshot edge portion against which chute 194 is engaged for positive alignment. The folded pocket blank 154 is then advanced through slot 190 and chute 194 into pocket receiver 220. Before retraction of folder blade 180, clamp assembly 278 is actuated to engage pocket blank 154.

In the preferred embodiment, an articulated clamp assembly 278 is provided beneath the nine o'clock position of pocket receiver 220 as illustrated in FIGS. 1 and 7. The clamp assembly 278 is thus operable to restrain each pocket blank 154 inserted into a receiver 220 positioned at the nine o'clock position. For example, clamp assembly 278 can comprise a double-acting cylinder coupled to an articulated hinge-like device adapted to grip the edge of a pocket blank 154 protruding from the bottom of a receiver 220, and to move out of interference with wheel 200 when deactuated. If desired, separate clamps could be provided within wheel 200 for each pocket receiver 220. Consequently, pocket blank 154 remains chambered in receiver 220 as blade 180 retracts. Chute 194 and clamp assembly 278 are then deactuated to non-interfering positions to permit rotation of wheel 200.

With the disengagement of pin 224, wheel 200 is allowed to rotate to the next position under the action of motor 208. The respective cam follower 228 disengages from camming surface 230 as receiver 220 is rotated to the twelve o'clock position from the nine o'clock position. Cylinders 272, which are responsive to the corresponding cam follower 228, are then actuated to press the longitudinal edges of folded pocket blank 154. Preferably, each presser bar 262 includes means for temperature maintenance thereof at an elevated level sufficient to activate adhesive 48. For example, each bar 262 could include an ultrasonic source (not shown). Alternatively, an external source of radiation or heat could be utilized. According to the preferred construction, an electrical resistance element 280 is provided within each bar 262. In this manner, the longitudinal edge strips of adhesive 48 within folded pocket blank 154 are simultaneously engaged and converted from a solid to a plastic state. It will be apparent that the extent of edge section activation is determined by the configuration of presser bars 262. In actual practice, it has been found desirable to notch (not shown) the upper portions of presser bars 262 so that only the lower edge sections of pocket blank 154 are bonded. It will be understood that any transverse adhesive strip in pocket blank 154 is neither engaged nor activated in receivers 220.

The presser bars 262 remain engaged as the receiver 220 is then indexed through at least one intermediate position. As shown, the twelve and three o'clock positions are non-functional. The temperature generated by and duration of engagement of bars 262 is sufficient over this interval to allow the desired portion of melted adhesive to permeate the edges of pocket blank 154. For example, when utilizing a polyamide or polyester adhesive and cotton pocket material, a pressure of about 7 psi for about 6 seconds at approximately 300–325 F has been found to yield a satisfactory bond. As the pocket receiver 220 approaches the removal position, camming surface 230 engages the respective cam follower 228 whereby presser bars 262 are deactuated. A prefabricated pocket comprising folded pocket blank 154 having at least the lower edge sections adhesively secured is thus free for removal.

As is shown best in FIG. 1, the prefabricated pockets are removed from receiver 220 at the six o'clock position of wheel 200 for subsequent implantation into a garment. If camming surface 230 were shortened, pockets could be removed at the three o'clock position, if desired. Each receiver 220, of course, is then indexed to the nine o'clock position for reloading again. If desired, a conventional stacker mechanism 284 could be mounted adjacent to wheel 200 to withdraw prefabricated pockets from receivers 220 at the desired position. For example, mechanism 284 could comprise a pair of selectively engagable clamps 286 carried at the end of an arm coupled to a double-acting cylinder 288, as shown in FIG. 1.

Figure 10:
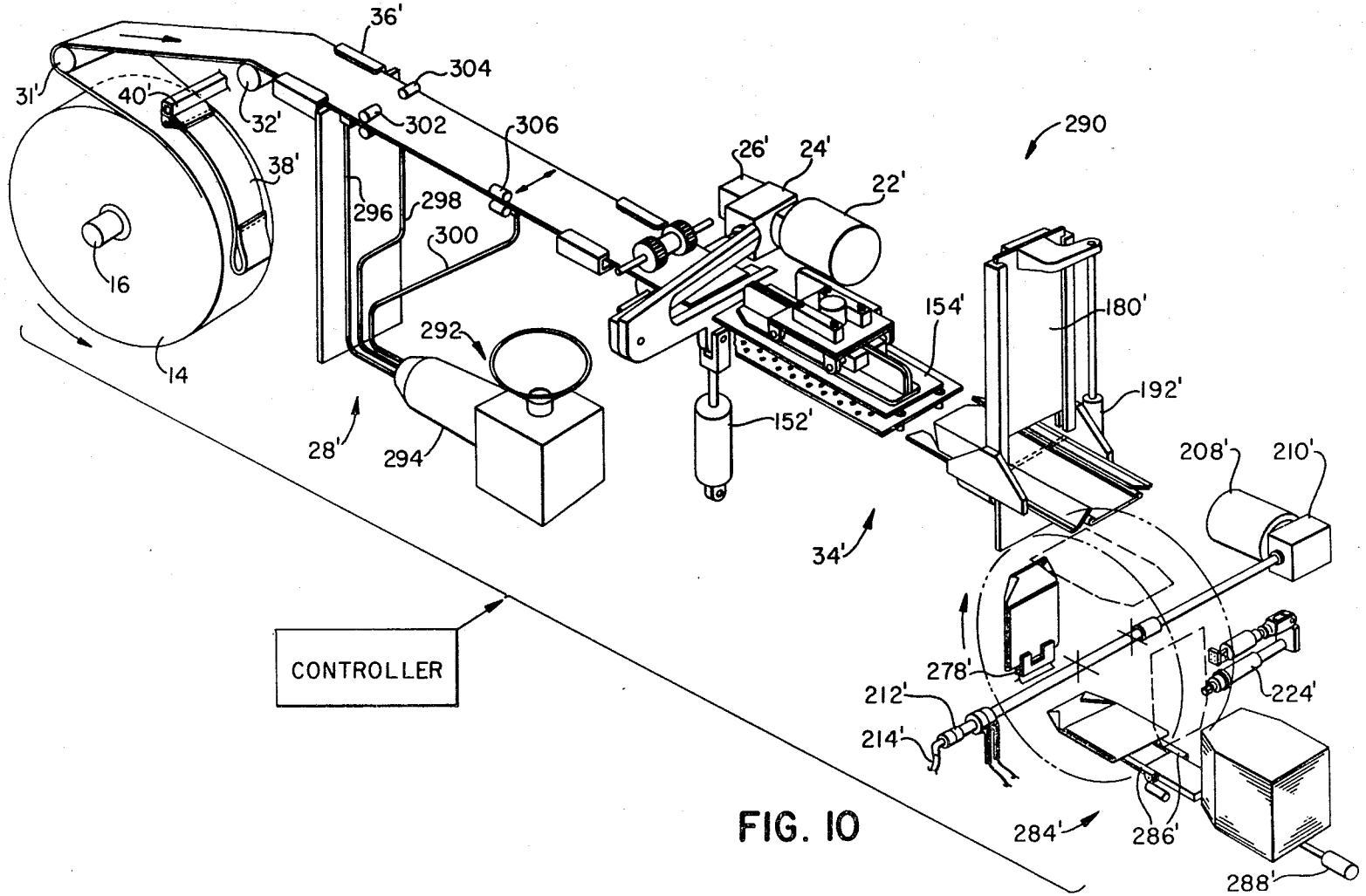
FIG. 10 is a perspective illustration of an apparatus for manufacturing pockets incorporating another embodiment of the invention.

Referring to FIG. 10, there is shown an apparatus for manufacturing pockets 290 incorporating a second embodiment of the invention. The apparatus 290 incorporates numerous component parts which are substantially identical in construction and operation to the component parts of apparatus 10 illustrated in FIGS. 1–9. These identical component parts are designated in FIG. 10 with the same reference numeral utilized in the description of apparatus 10, but are differentiated therefrom with a prime (') designation.

The primary differentiation between apparatus 290 and apparatus 10 comprises the use of extrusion assembly 292. Extrusion assembly 292 comprises an extruder 294 having output tubes 296, 298 and 300 connected thereto. Output tubes 296 and 298 terminate in nozzles (not shown) positioned adjacent to the reverse side of the longitudinal edges of material 12. The longitudinal edges of material 12 are nipped between pairs of rollers 302 and 304, which are preferably coated with a non-stick substance such as TEFLON. Output tube 300, which is flexible, terminates in a movable nozzle (not shown) positioned adjacent to the reverse side of material 12 in spaced relationship with the other nozzles. Another pair of nip rollers 306 is mounted for transverse movement across material 12 together with the nozzle associated with output tube 300 by means of suitable structure, which as been omitted from FIG. 10 for clarity. Flow of adhesive through tubes 296, 298 and 300 is controlled by means of suitable valves. Responsive to advancement of material 12, liquid adhesive is discharged through tubes 296 and 298 and their respective nozzles directly onto the material in the form of beads, which are flattened into adhesive ribbons by nip rollers 302 and 304. While material 12 is stationary between advancements thereof, liquid adhesive is permitted to flow only through output tube 300. Simultaneously, nip rollers 306 and the nozzle associated with output tube 300 traverse material 12 to apply a transverse strip of adhesive to the reverse side of the material. Aside from the foregoing distinctions, apparatus 290 functions in all other respects substantially identically to apparatus 10 hereinbefore described.

Figure 11:
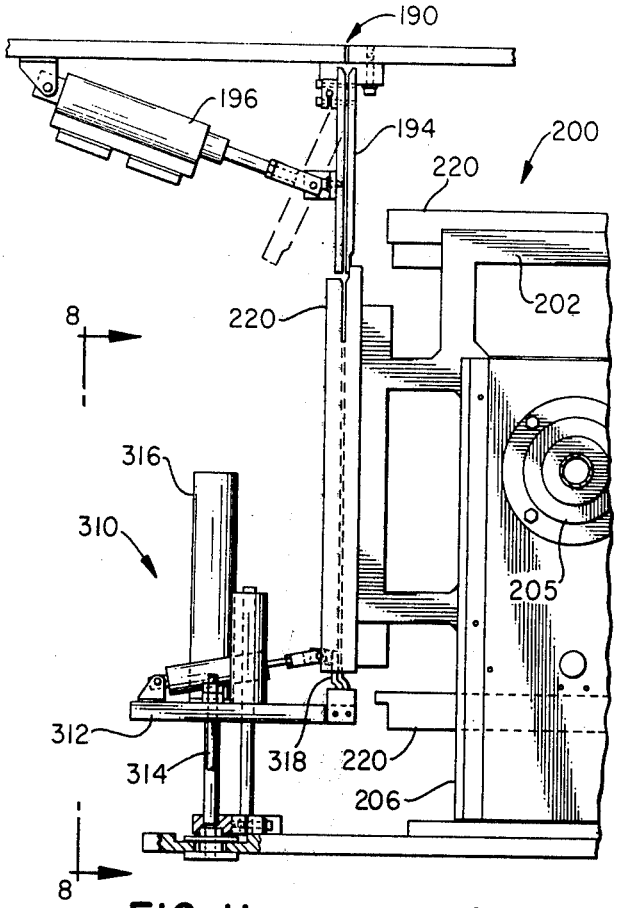
FIG. 11 is a side elevational view of a first modification of the pocket wheel portion of the invention.
Figure 12:
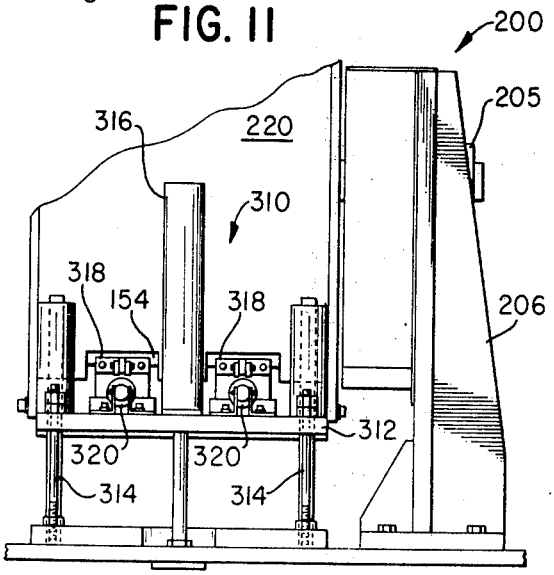
FIG. 12 is an end view of FIG. 11.

Referring to FIGS. 11 and 12, there is shown a first modification of the pocket wheel 200. Clamp assembly 278 was hereinbefore described with respect to FIGS. 1 and 7. Pocket retainer assembly 310 shown in FIGS. 11 and 12 can be substituted for clamp assembly 278. Assembly 310 includes a plate 312 mounted for vertical movement along rods 314 responsive to actuation by double acting cylinder 316. Supported on plate 312 are a pair of pocket clamps 318 actuated by double acting cylinders 320. Pocket retainer assembly 310 is movable along rods 312 between interfering and noninterfering positions. When a pocket receiver 220 is indexed to the nine o'clock position by pocket wheel 200, cylinder 316 elevates plate 312 and cylinders 320 actuate clamps 318 to restrain pocket blank 154 during withdrawal of folder blade 180. With a folded pocket blank 154 thus properly chambered within pocket receiver 220, clamps 318 are disengaged, platform 312 is lowered, and chute 194 is pivoted away to permit rotation of pocket wheel 200.

Figure 13:
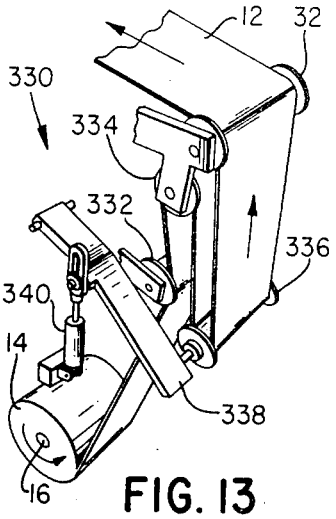
FIG. 13 is a perspective illustration of the material feed portion of the invention.

Referring to FIG. 13, there is shown an accessory for better control of material feed from supply roll 14. Under some conditions, it has been found that the inertial momentum of supply roll 14 can cause slack to develop in material 12 during rapid intermittent advancements of the material from the roll. Storage and feed assembly 330 overcomes this problem.

Assembly 330 includes additional rollers 332, 334 and 336 for use with existing roller 32. Roller 336 is mounted on a pivotal arm 338 and comprises a dancer roller. Rollers 332 and 334 comprise idler rollers mounted in stationary relationship. Material 12 extends from supply roll 14 over roller 332 and around rollers 334 and 336. Pivotal arm 338 is coupled to a double acting cylinder 340 by means of a lost motion connection. In response to advancement of material 12, dancer roller 336 and pivotal arm 338 are pulled upward. While material 12 is halted between advancements thereof, cylinder 340 pulls dancer roller 336 and pivot arm 338 downward to withdraw material for the next advancement from supply roll 14. It will thus be appreciated that assembly 330 withdraws and stores material 12 in an amount corresponding to each advancement of the material during the pocket prefabrication operation.

Figure 15:
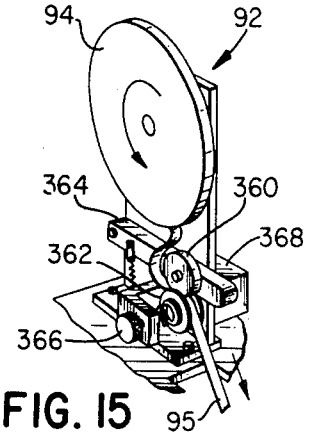
FIG. 15 is an illustration of a second modification of the adhesive application portion of the invention.
Figure 14:
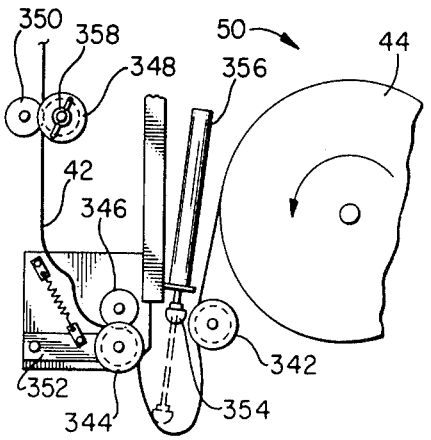
FIG. 14 is a side elevational view of a first modification of the adhesive applicator portion of the invention.

Referring to FIGS. 14 and 15, there are shown accessories directed to improvement of the adhesive ribbon feed in apparatus 10. FIG. 14 shows an accessory for use with applicator assemblies 50, while FIG. 15 shows an accessory for use with applicator assembly 92.

In FIG. 14, roller 342, a pair of rollers 344 and 346, and a pair of rollers 348 and 350 are added along the path of each ribbon 42. Roller 344 is carried on a pivotal arm 352 for biased engagement with roller 346. Roller 350 is carried on another pivotal arm (not shown) for biased engagement with roller 348. Ribbon 42 is thus nipped between rollers 344 and 346 and rollers 348 and 350. A smooth pusher bar 354 is extended by double acting cylinder 356 between the positions shown in full and dashed lines to withdraw a length of adhesive ribbon 42 from supply roll 44 between advancements of the ribbon. It will be appreciated that the use of pusher bar 354 and cylinder 356 effect withdrawal of ribbon 42 while feed roller 54 shown in FIG. 2 effects advancement thereof. The development of slack in ribbon 42 is thus significantly reduced. Preferably, roller 348 includes a friction adjustment nut 358 to provide for an adjustable drag or brake force on the ribbon 42. If desired, a suitable rotary encoder (not shown) can be attached to roller 346 to monitor the exact amount of adhesive ribbon 42 being fed. It will thus be appreciated that the additional components shown in FIG. 14 enhance the precision of applicator assemblies 50.

In FIG. 15, rollers 360 and 362 have been added to the path of adhesive ribbon 95 in applicator assembly 92. Roller 360 is carried on a pivotal arm 364 for biased engagement with roller 362. Adhesive ribbon 95 is thus nipped between rollers 360 and 362. Preferably, roller 362 includes a friction adjustment nut 366 to provide adjustable drag or brake force on the ribbon 95. If desired, a suitable rotary encoder 368 can be coupled to roller 362 to monitor the amount of ribbon 95 fed by applicator assembly 92. If desired, an extensible pusher bar arrangement similar to that shown in FIG. 14 can be used for advancement of ribbon 95 from supply roll 94. It will thus be appreciated that the additional components shown in FIG. 15 enhance the operational precision of applicator assembly 92.

Figures 16, 29:
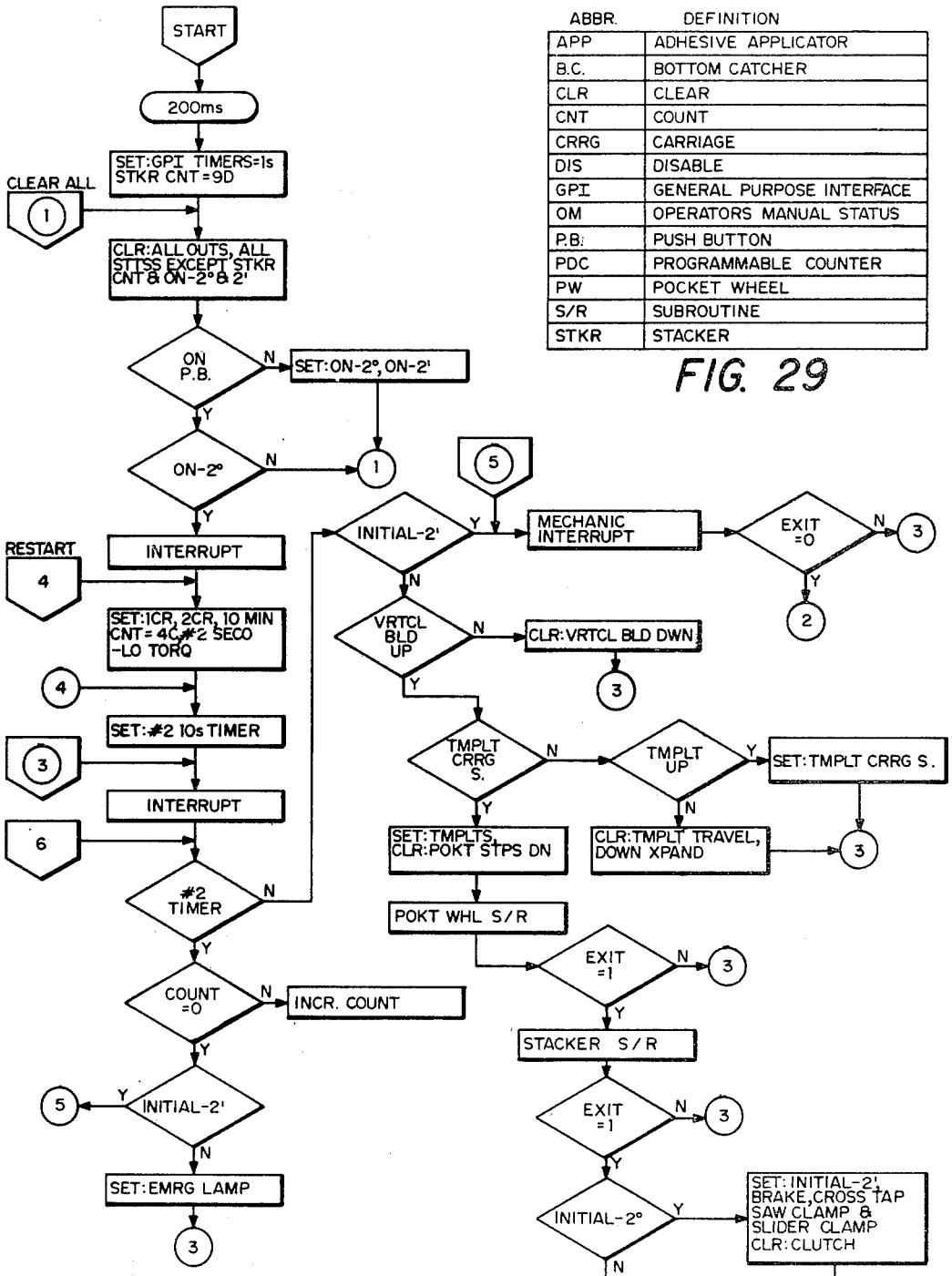
Figure 18A:
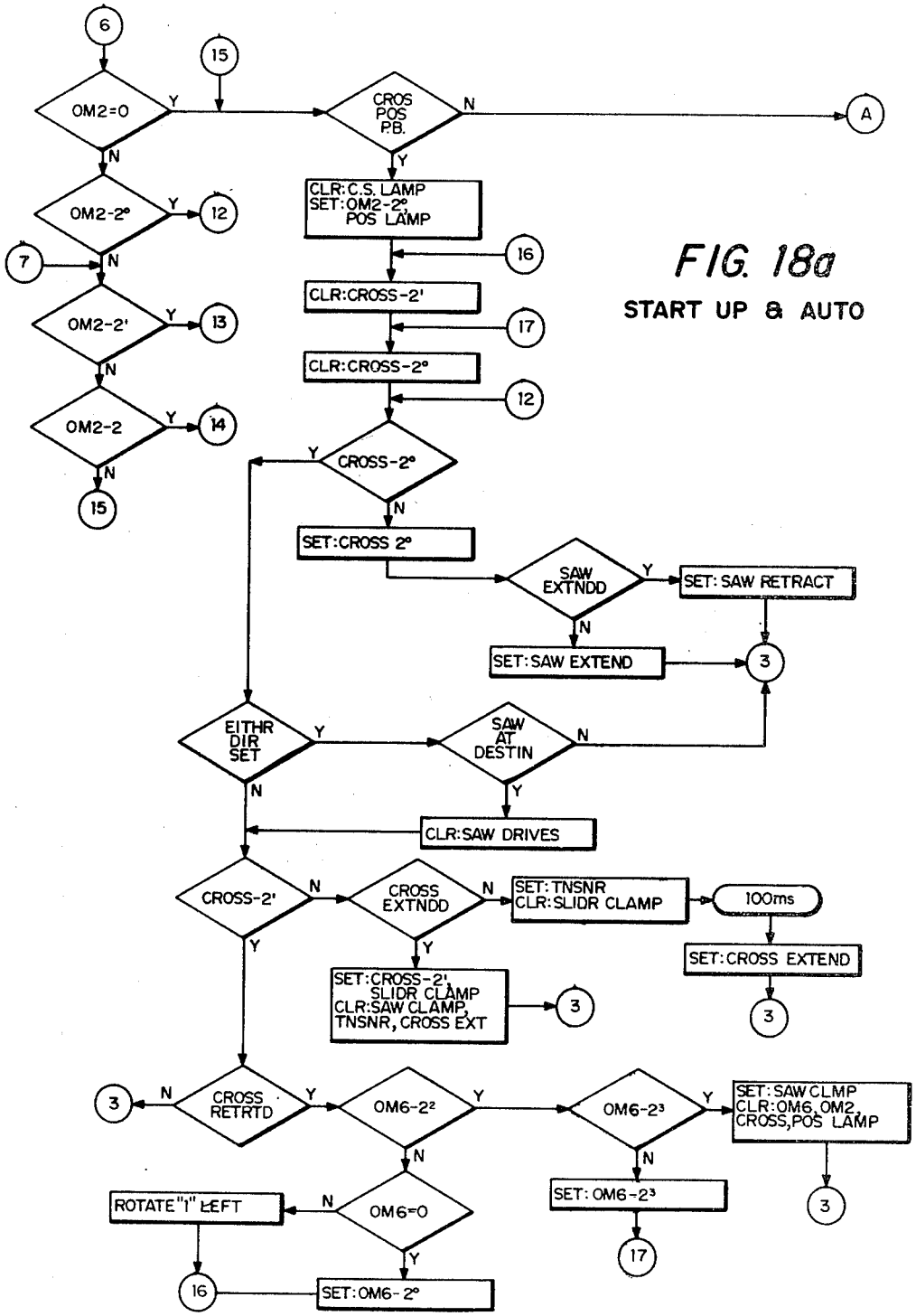
Figure 20:
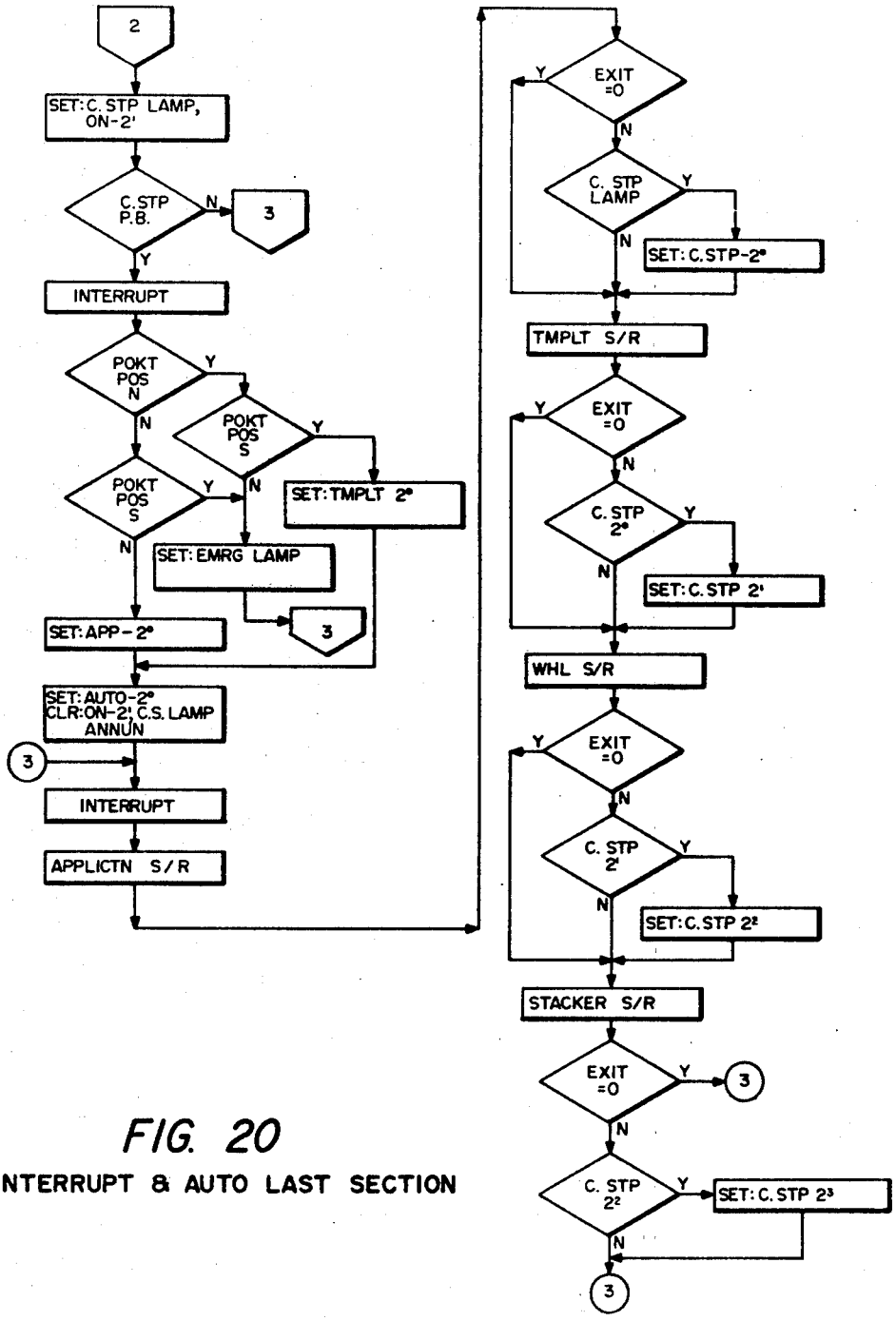
Figure 21:
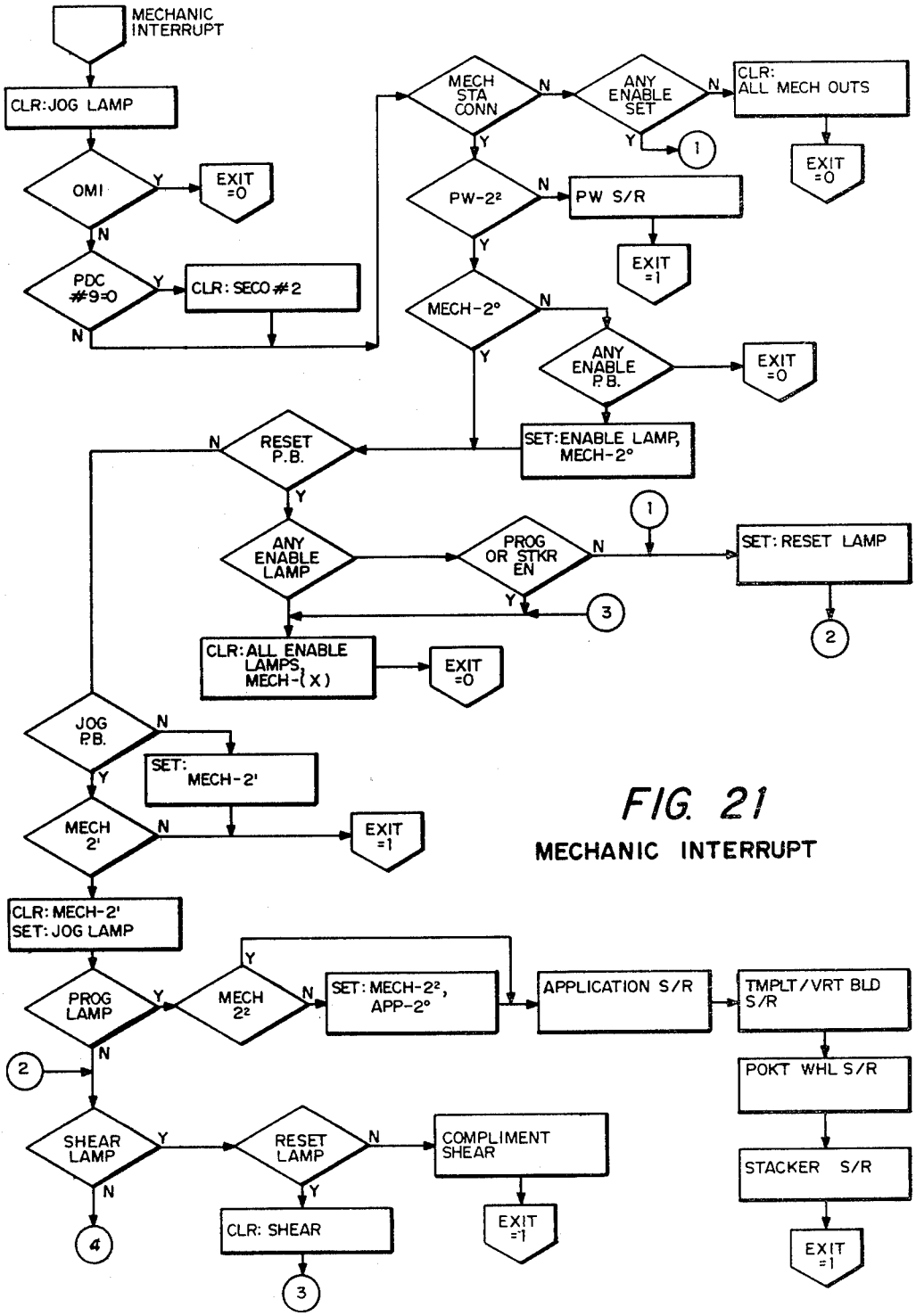
Figure 22A:
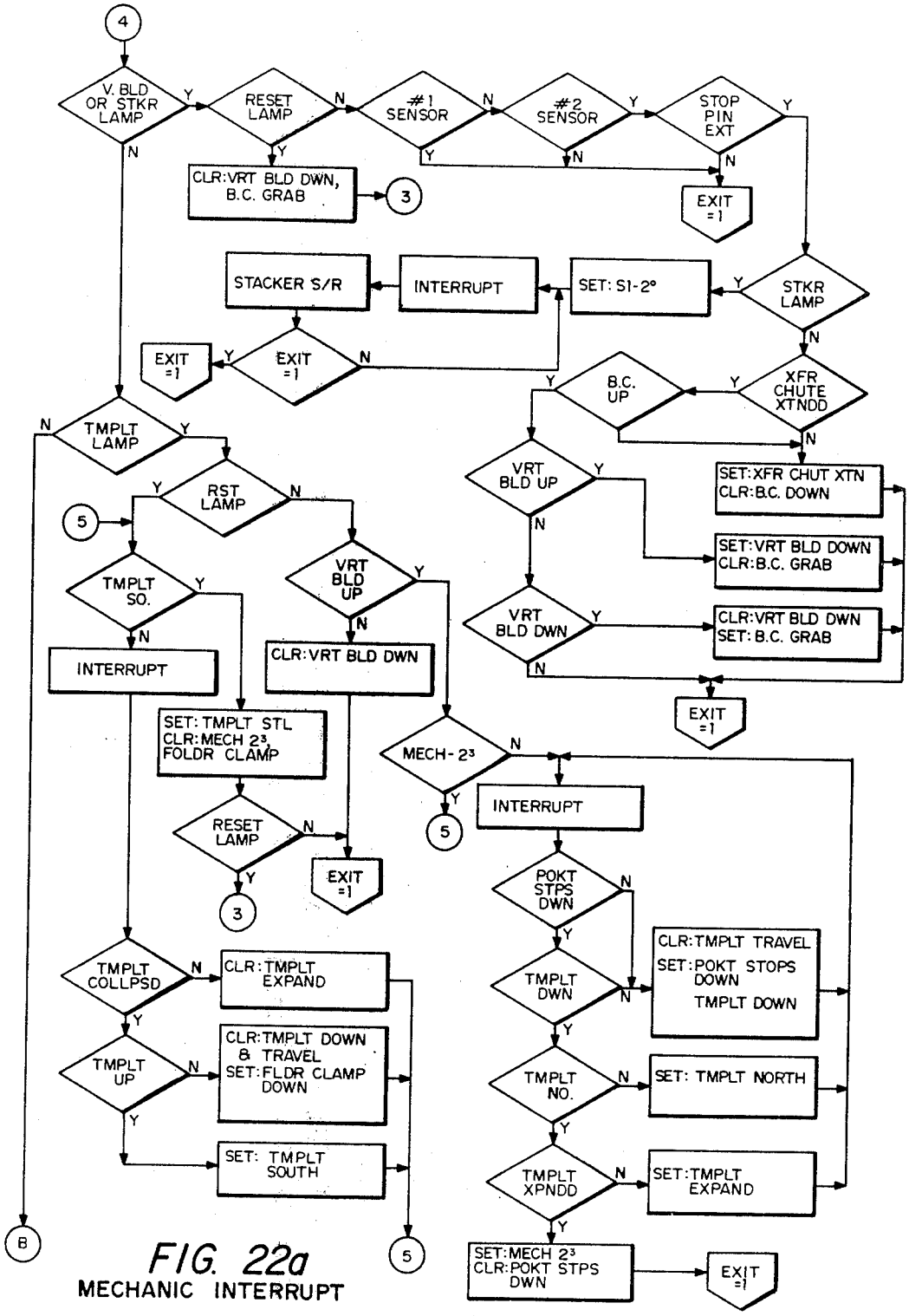
Figure 22B:
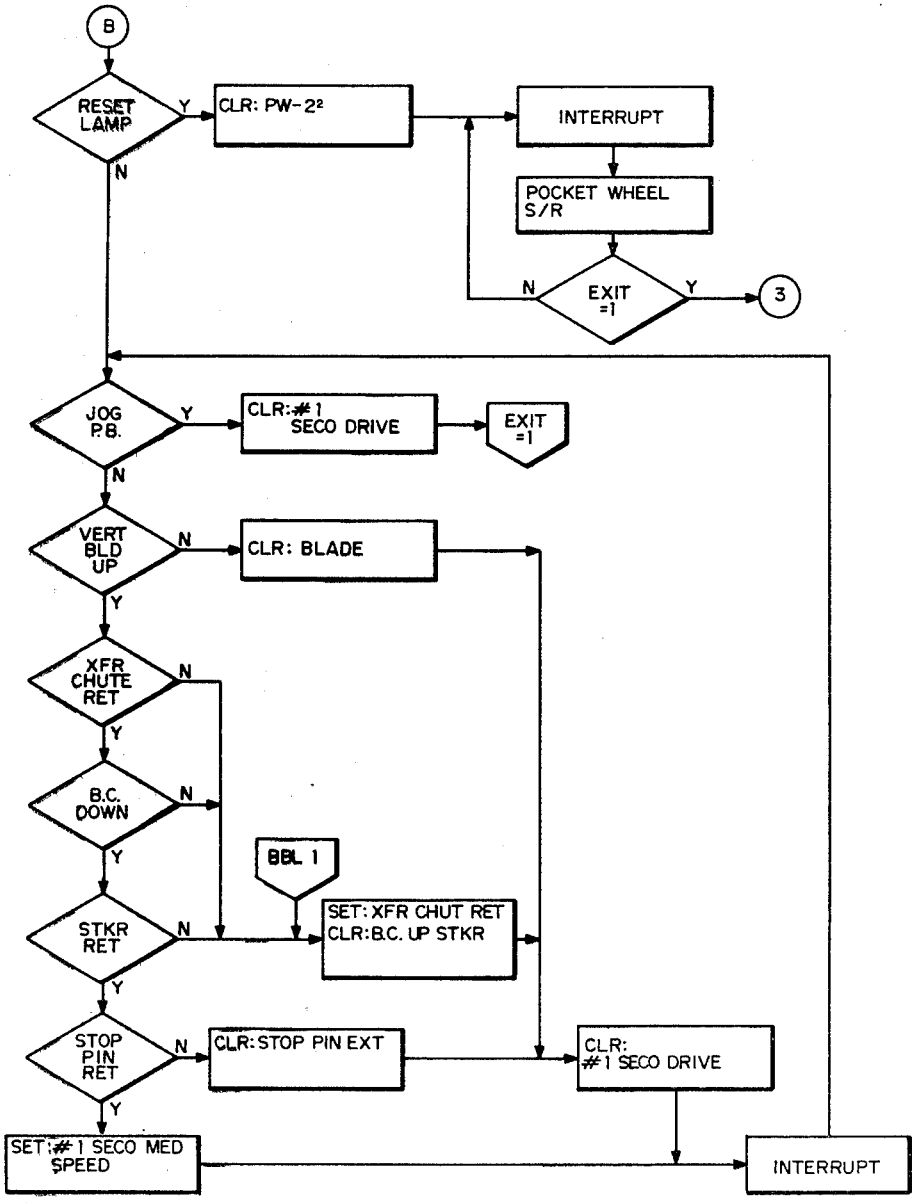
Figure 23:
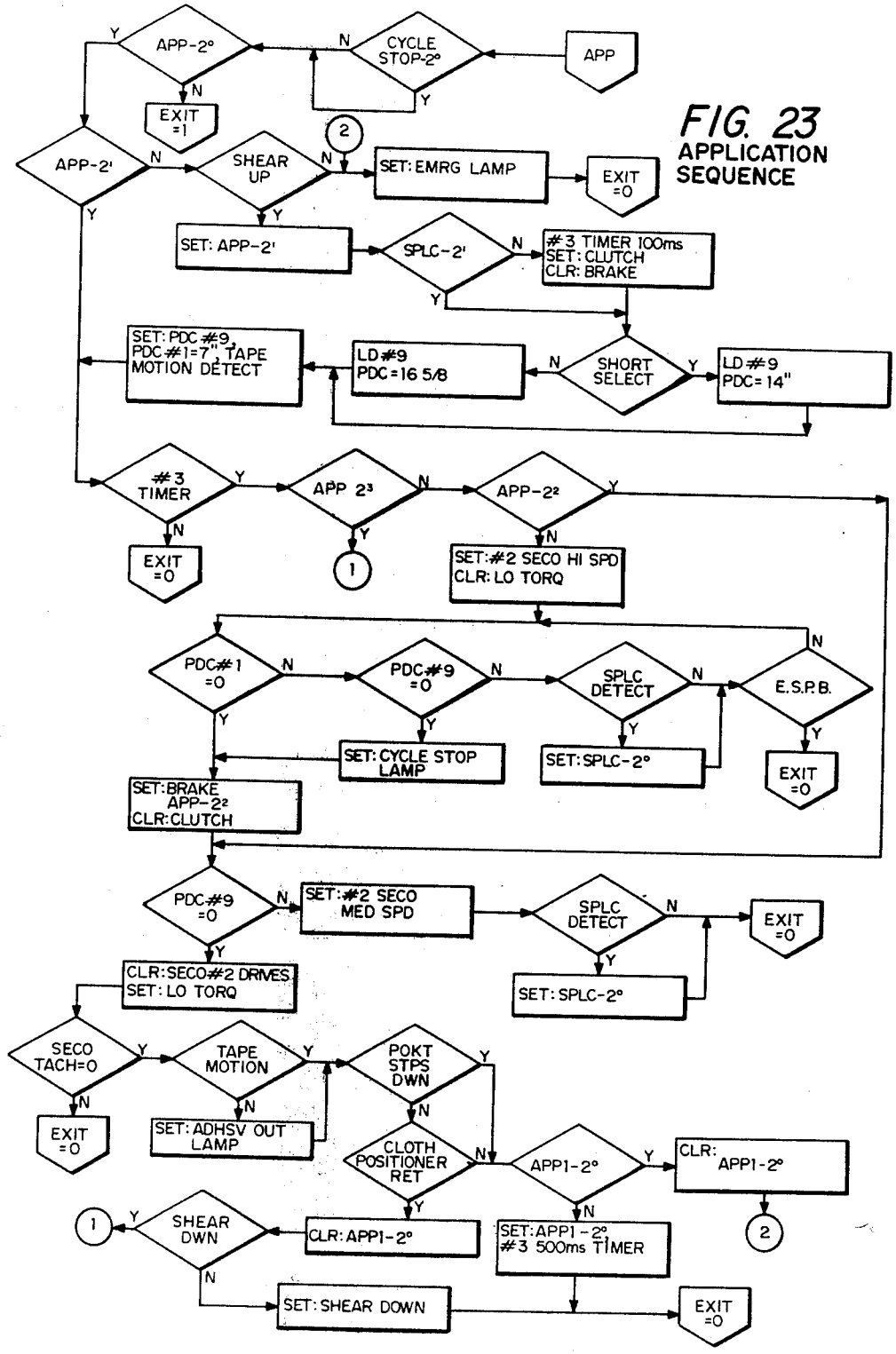
Figure 24:
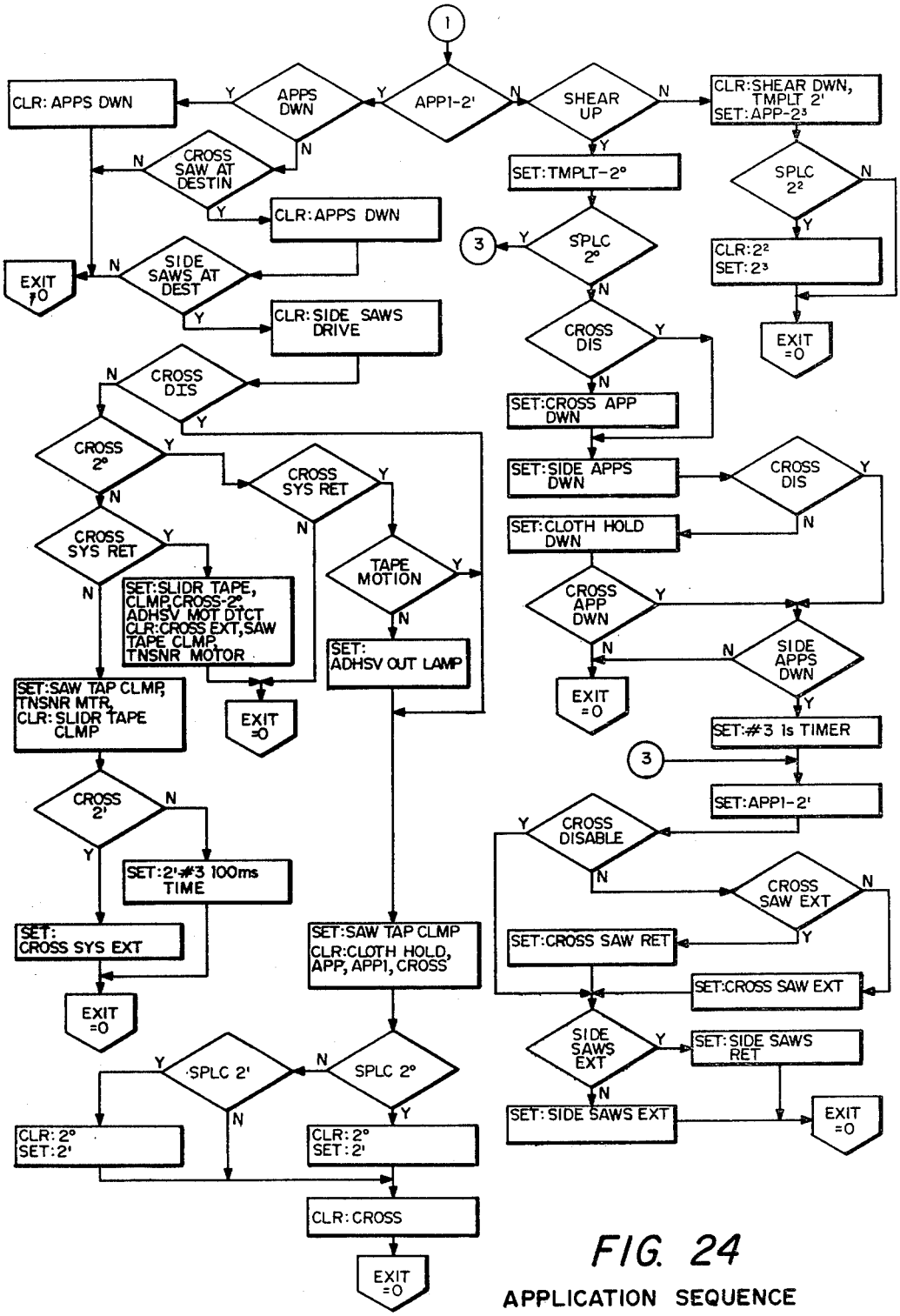
Figure 25:
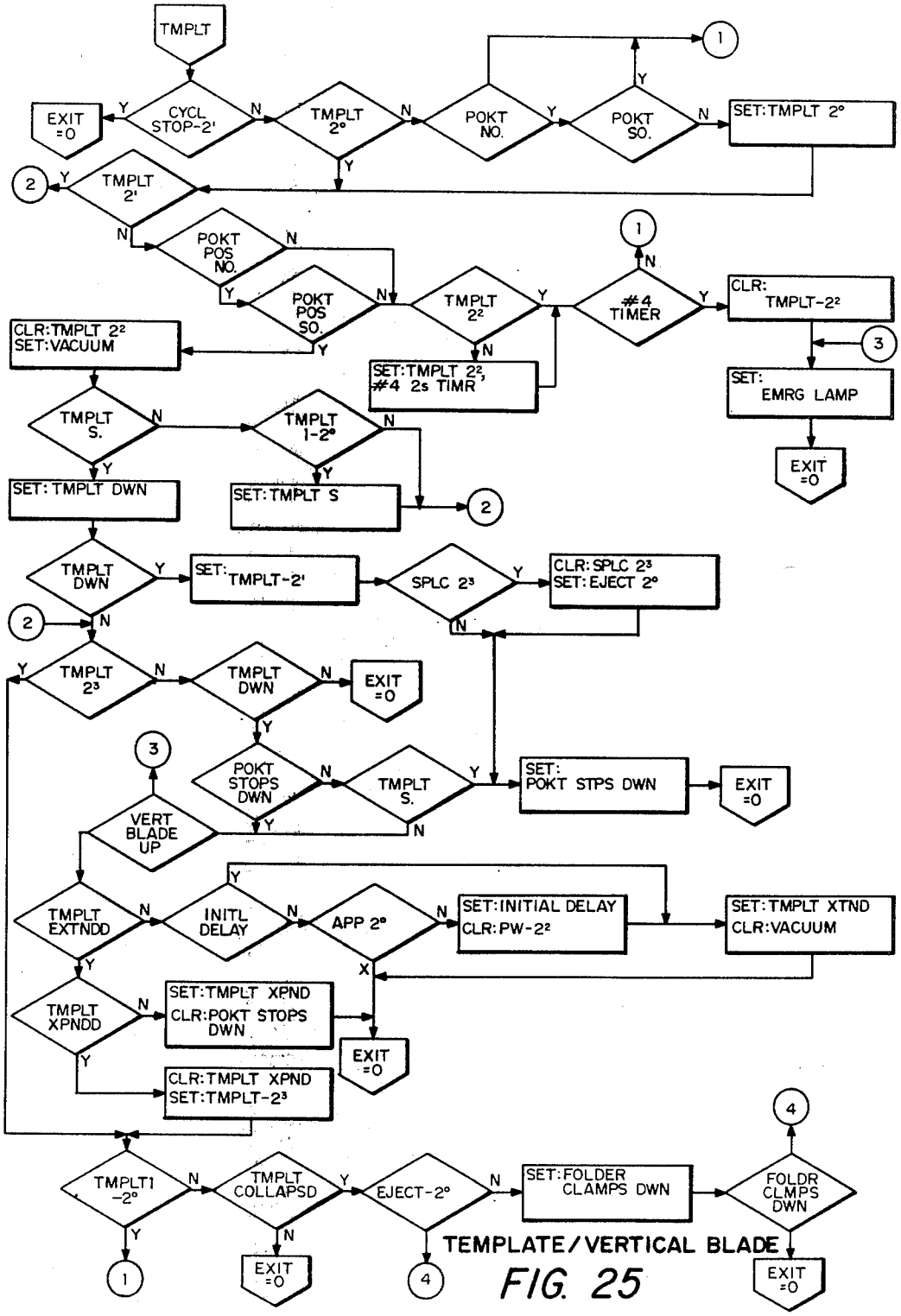
Figure 26:
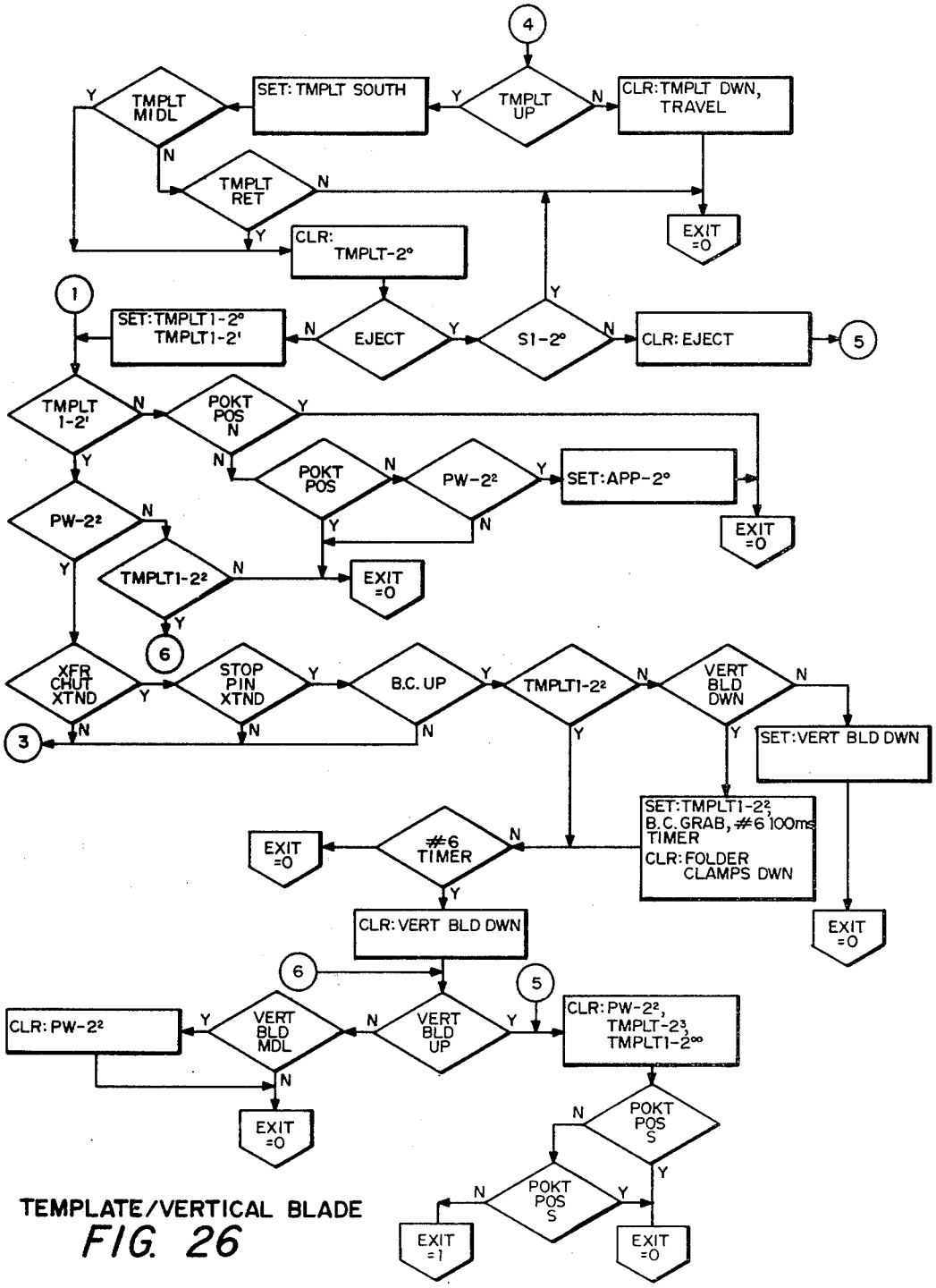
Figure 27A:
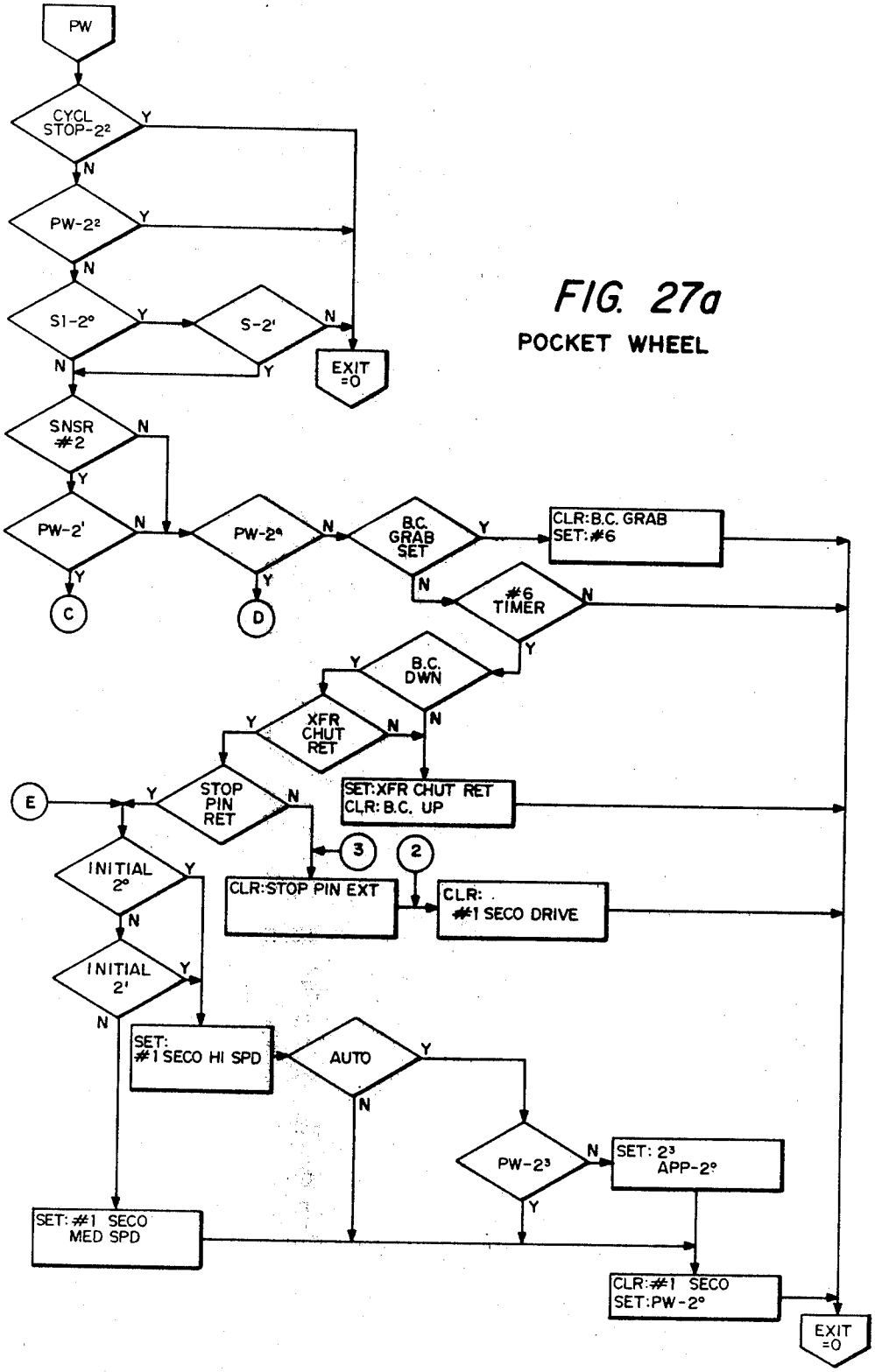
Figure 27B:
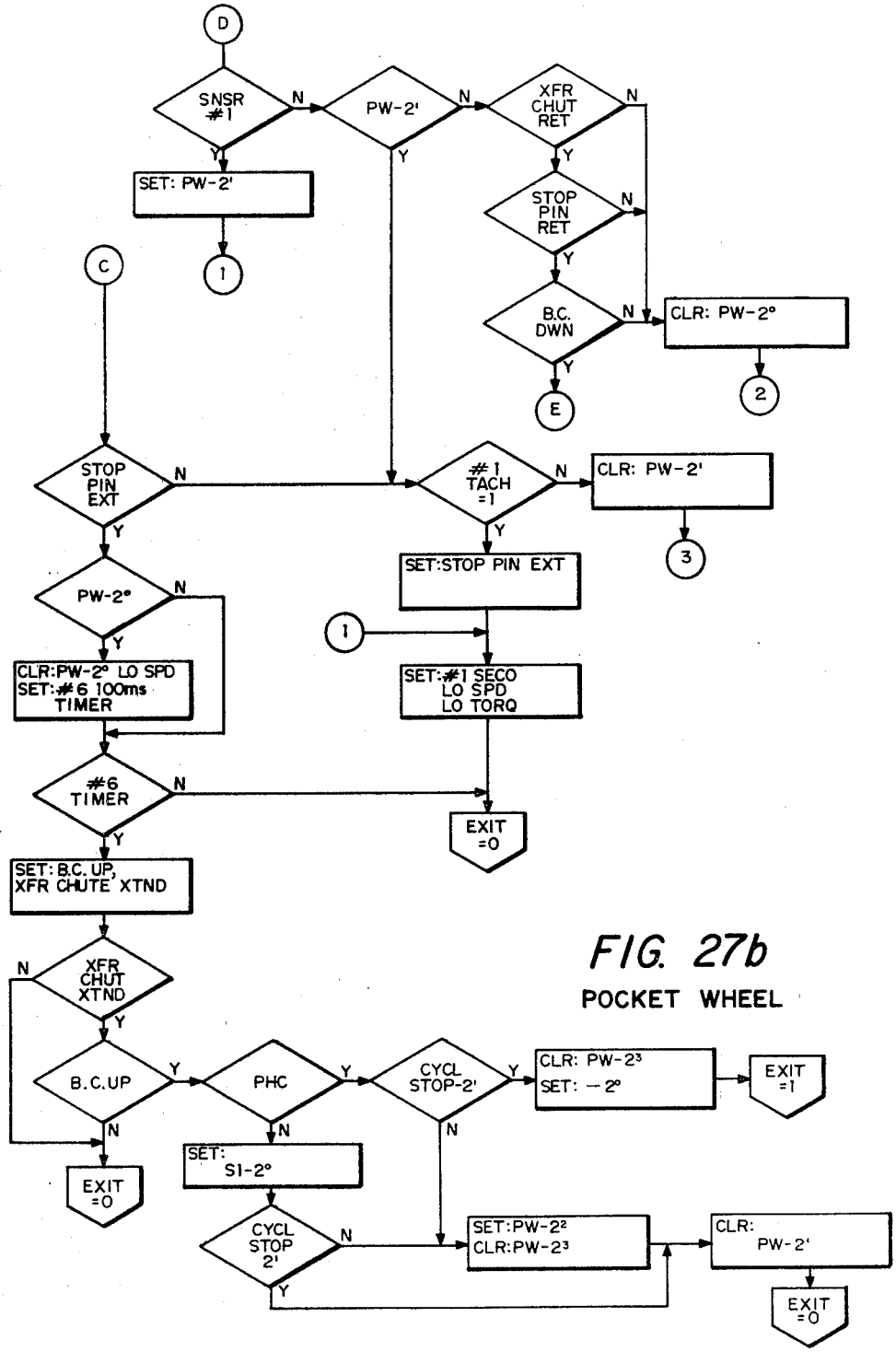
Figure 28:
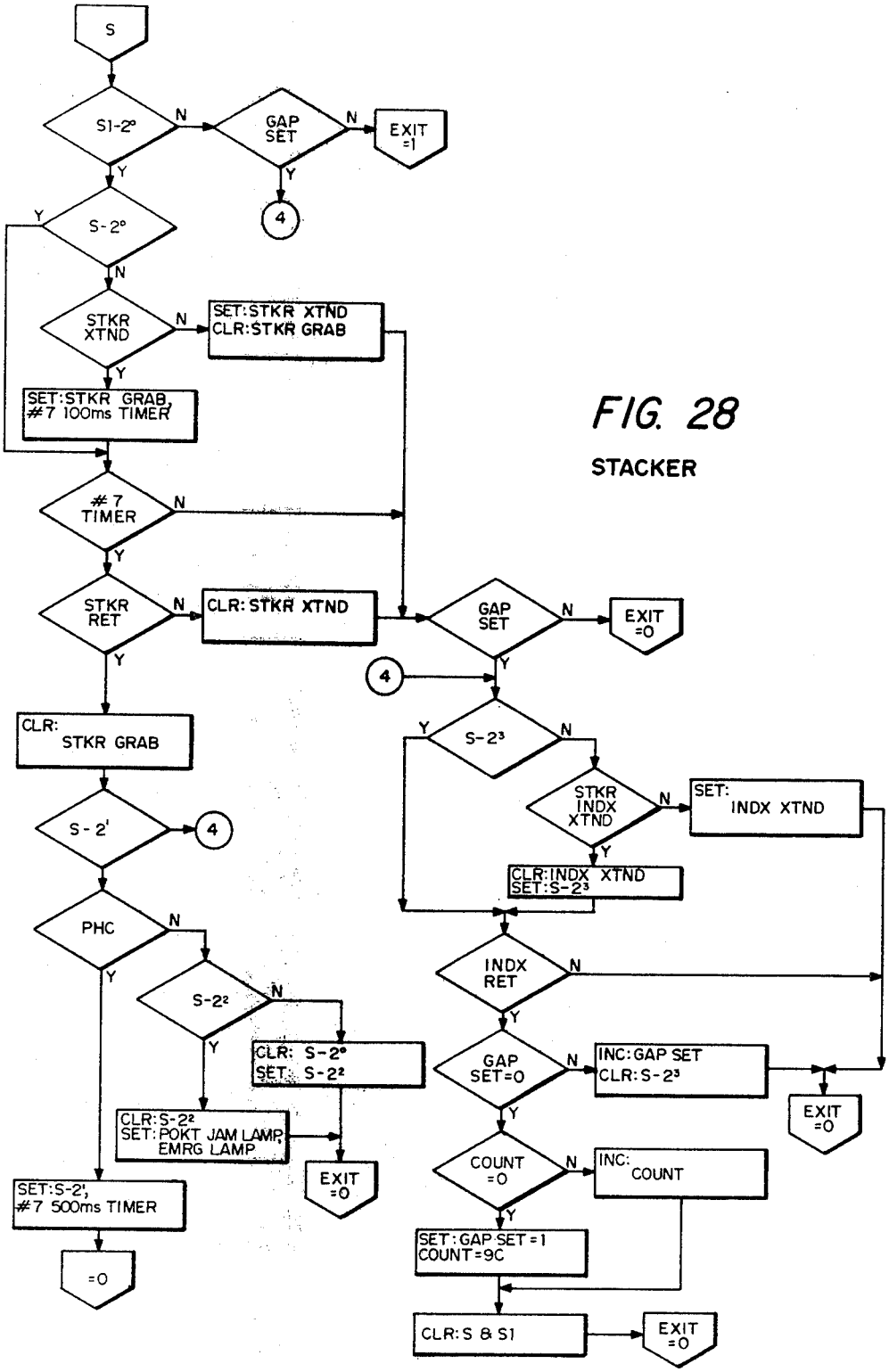

Referring now to FIGS. 16–28, there are shown the logic flow charts employed in accomplishing the operations of apparatus 10 hereinabove described. FIG. 29 contains a table explaining some of the abbreviations appearing in the flow chart. The remainder of the abbreviations are derivations of full words, with the vowels omitted, and are believed self explanatory. For example, "BLD" means blade; "THRD" means third; "TMPLT" means template; "TNSNR" means tensioner and so forth. The word "CROSS" throughout the flow charts refers to adhesive applicator assembly 92, which applies a transverse strip of adhesive to pocket material 12. The detailed flow charts represent instructions programmed into the controller shown in FIGS. 1 and 10. Any suitable microprocessor of sufficient capacity can be employed. In actual practice, a microprocessor made by Intel Corporation of California and packaged by Prolong Corporation has been found satisfactory. Complete disclosure of the logic and the structure employed in the invention is sufficient to enable one with ordinary skill in the art to make and use apparatus 10.

From the foregoing, it will be understood that the present invention comprises an apparatus and method for prefabricating pockets which incorporates numerous advantages over the prior art. One important advantage deriving from the present invention involves the elimination of numerous manual operations which were heretofore required in the construction of pockets. Individual pockets are automatically prefabricated on a continuous basis utilizing materials carried on supply reels. Further important benefits derive from the use of fusible materials as a replacement for mechanical stitches in the construction process. Other advantages attending the use of the invention will readily suggest themselves to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, modifications, and rearrangements and substitutions of parts or elements as fall within the spirit and scope of the invention.

What is claimed is:

1. Apparatus for applying adhesive strips to material selectively advanced along a material path, comprising:

feed means for selectively advancing along a predetermined ribbon path ribbon comprised of a layer of adhesive carried on a backing;

said feed means including a dual diameter drive roller and two nip rollers with said ribbon being engaged between one nip roller and the relatively smaller diameter portion of the drive roller;

cutting means located along the ribbon path for selectively effecting separations at intervals in only the adhesive layer of the ribbon to form successive strips of adhesive therefrom;

support means forming a portion of the ribbon path beyond the cutting means and adjacent to the material path; and means located opposite the support means for selectively engaging the material and individual adhesive strips positioned on the support means to attach the adhesive strips to the material;

said backing extending sharply away from the support means and being engaged between the other nip roller and the relatively larger diameter portion of the drive roller so that the backing is disconnected from the attached adhesive strip and advanced for collection concurrently with advancement of the ribbon.

2. The apparatus of claim 1, wherein the adhesive is fusible and further including:

means for activating each adhesive strip essentially simultaneously upon engagement with the material.

3. The apparatus of claim 1, wherein the cutting means comprises:

a rotating milling wheel mounted for movement across the ribbon path;

means for selectively displacing said milling wheel across the ribbon path; and guide means located opposite the milling wheel and forming a portion of the ribbon path for stabilizing the ribbon during the cutting operation.

4. The apparatus according to claim 3, wherein the guide means comprises an anvil having two predetermined slots formed therein, one slot comprising a guide way for the milling wheel and the other slot comprising a guide way for the ribbon.

5. The apparatus according to claim 4, wherein said anvil includes a plurality of bores opening onto the slot comprising the guide way for the ribbon, said bores being connected to a vacuum source so as to maintain positive engagement between the ribbon and the anvil.

6. The apparatus of claim 1, wherein the adhesive comprises fusible adhesive, and wherein the means for engaging the material and the adhesive strips comprises:

a heated head mounted for displacement toward the support means; and means for selectively displacing said heated head.

7. The apparatus of claim 1, wherein the ribbon is advanced from a supply roll, and further including:

a pusher bar mounted for displacement across the ribbon path between the supply roll and the feed means; and means for selectively displacing the pusher bar to withdraw predetermined amounts of ribbon from the supply roll between advancements of the ribbon by the feed means.

8. Apparatus for applying adhesive strips to material selectively advanced along a material path, comprising:

a carriage mounted for movement between positions adjacent to the material path and away from the material path;

feed means supported on the carriage for selectively advancing along a predetermined path ribbon comprised of adhesive carried on a backing strip;

support means forming a portion of the ribbon path, said support means being attached to the carriage;

means located opposite the support means for selectively engaging the material and individual adhesive areas positioned on the support means to interconnect the adhesive and the material;

means for selectively immobilizing the ribbon upon movement of the carriage and support means to a position away from the material path to allow advancement of the backing strip and thus disconnection of the backing from the attached adhesive area; and means for selectively immobilizing the backing with respect to the carriage to allow advancement of the ribbon upon return of said carriage to a position adjacent to the material path.

9. The apparatus of claim 8, wherein the adhesive is fusible, and further including:

means for activating each adhesive zone substantially simultaneously upon engagement with the material.

10. The apparatus of claim 8 further including cutting means comprising:

a rotating milling wheel mounted for movement across the ribbon path;

means for selectively displacing said milling wheel across the ribbon path; and guide means forming a portion of the ribbon path adjacent to the milling wheel for stabilizing the ribbon during the cutting operation.

11. The apparatus according to claim 10, wherein said guide means comprises an anvil having two predetermined slots therein for receiving the milling wheel and guiding the ribbon.

12. The apparatus of claim 8, wherein the adhesive is fusible, and wherein the means for engaging the material and the adhesive areas comprises:

a heated head mounted for displacement toward the support means; and means for selectively displacing said heated head.

13. The apparatus of claim 8, further including:

means for selectively immobilizing the material during movement of said carriage.

* * * * *